US008740659B2

(12) United States Patent
Kuriyagawa et al.

(10) Patent No.: US 8,740,659 B2
(45) Date of Patent: Jun. 3, 2014

(54) OUTBOARD MOTOR CONTROL APPARATUS

(75) Inventors: Koji Kuriyagawa, Saitama (JP); Hiroshi Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 172 days.

(21) Appl. No.: 13/401,904

(22) Filed: Feb. 22, 2012

(65) Prior Publication Data

US 2012/0231684 A1 Sep. 13, 2012

(30) Foreign Application Priority Data

Mar. 7, 2011 (JP) ..... 2011-048847
Mar. 7, 2011 (JP) ..... 2011-048848
Mar. 7, 2011 (JP) ..... 2011-048849

(51) Int. Cl.
*B63B 21/22* (2006.01)

(52) U.S. Cl.
USPC ..... 440/1; 440/84

(58) Field of Classification Search
USPC ..... 440/1, 84
See application file for complete search history.

(56) References Cited

U.S. PATENT DOCUMENTS 5,122,084 A 6/1992 Lieb et al.
7,214,164 B2 * 5/2007 Shomura et al. ..... 477/113
7,455,559 B2 * 11/2008 Ito et al. ..... 440/75
2006/0135314 A1 * 6/2006 Shomura et al. ..... 477/109

FOREIGN PATENT DOCUMENTS

JP 3-079496 A 4/1991

* cited by examiner

*Primary Examiner* — Stephen Avila
(74) *Attorney, Agent, or Firm* — Carrier Blackman & Associates, P.C.; Joseph P. Carrier; Jeffrey T. Gedeon

(57) ABSTRACT

In an apparatus for controlling operation of an outboard motor that has an internal combustion engine equipped with a plurality of cylinders and is configured to switch a shift position between an in-gear position that enables engine's driving force to be transmitted to a propeller and a neutral position that cuts off transmission of the driving force, it is configured such that a neutral operation detector detects a neutral operation in which the shift position is switched from the in-gear position to the neutral position; a driving force controller conducts driving force decreasing control to decrease the driving force when the neutral operation is detected; and a cylinder number changer detects an engine speed variation range during the driving force decreasing control and, of the plurality of the cylinders, determines and changes the number of the cylinders with which the control is to be conducted based on the variation range.

13 Claims, 23 Drawing Sheets

FIG. 11

| ENGINE SPEED VARIATION RANGE DNE | NUMBER OF CYLINDERS TO BE CONDUCTED WITH SHIFT LOAD DECREASING CONTROL |
|---|---|
| DNE < 200 rpm | 3 |
| 200 rpm ≦ DNE < 300 rpm | 2 |
| 300 rpm ≦ DNE < 400 rpm | 1 |
| 400 rpm ≦ DNE | 0 |

OUTBOARD MOTOR CONTROL APPARATUS

BACKGROUND

1. Technical Field

Embodiments of the invention relate to an outboard motor control apparatus, particularly to an apparatus for controlling driving force of an internal combustion engine mounted on an outboard motor to mitigate load on the operator caused by manipulating of a shift lever.

2. Background Art

Conventionally, there is proposed a technique of an outboard motor control apparatus to displace a clutch in response to the manipulation of a shift lever by the operator, so that a shift position can be changed between a so-called in-gear position, i.e., forward or reverse position, in which a forward or reverse gear is in engagement and the driving force of an internal combustion engine is transmitted to a propeller, and a neutral position in which the engagement is released and the transmission of the driving force is cut off, as taught, for example, by Japanese Laid-Open Patent Application No. Hei 3 (1991)-79496 ('496).

In the reference, a switch is provided at the shift lever and when a neutral operation in which the shift position is changed from the in-gear position to the neutral position is detected through the switch, the ignition cut-off of the engine is carried out to conduct driving force decreasing control. Consequently, it makes easy to release the engagement of the clutch with the forward or reverse gear (in-gear condition), thereby mitigating burden or load on the operator caused by the shift lever manipulation.

SUMMARY

However, when the driving force decreasing control is performed as in the technique of the reference, the engine speed is sometimes excessively varied depending on the operating condition of the engine. It may adversely affect the combustion, resulting in the engine stall or other disadvantages.

An object of embodiments of this invention is therefore to overcome the foregoing problem by providing an outboard motor control apparatus that can appropriately decrease the driving force of an internal combustion engine to mitigate load on the operator caused by the shift lever manipulation, while preventing the engine stall.

In order to achieve the object, the embodiments of the invention provide in the first aspect an apparatus for controlling operation of an outboard motor having an internal combustion engine equipped with a plurality of cylinders, the outboard motor being configured to switch a shift position between an in-gear position that enables driving force of the engine to be transmitted to a propeller by engaging a clutch with one of a forward gear and a reverse gear and a neutral position that cuts off transmission of the driving force by disengaging the clutch from the forward or reverse gear, comprising a neutral operation detector adapted to detect a neutral operation in which the shift position is switched from the in-gear position to the neutral position; a driving force controller adapted to conduct driving force decreasing control to decrease the driving force of the engine when the neutral operation is detected; and a cylinder number changer adapted to detect a variation range of a speed of the engine during the driving force decreasing control and determine and change number of the cylinders with which the driving force decreasing control is to be conducted out of the plurality of the cylinders based on the detected variation range.

BRIEF DESCRIPTION OF DRAWINGS

The above and other objects and advantages of embodiments of the invention will be more apparent from the following description and drawings in which:

FIG. 11 is an explanatory view showing mapped data used in the process in FIG. 10;

DESCRIPTION OF EMBODIMENTS

An outboard motor control apparatus according to embodiments of the present invention will now be explained with reference to the attached drawings.

Figure 1:
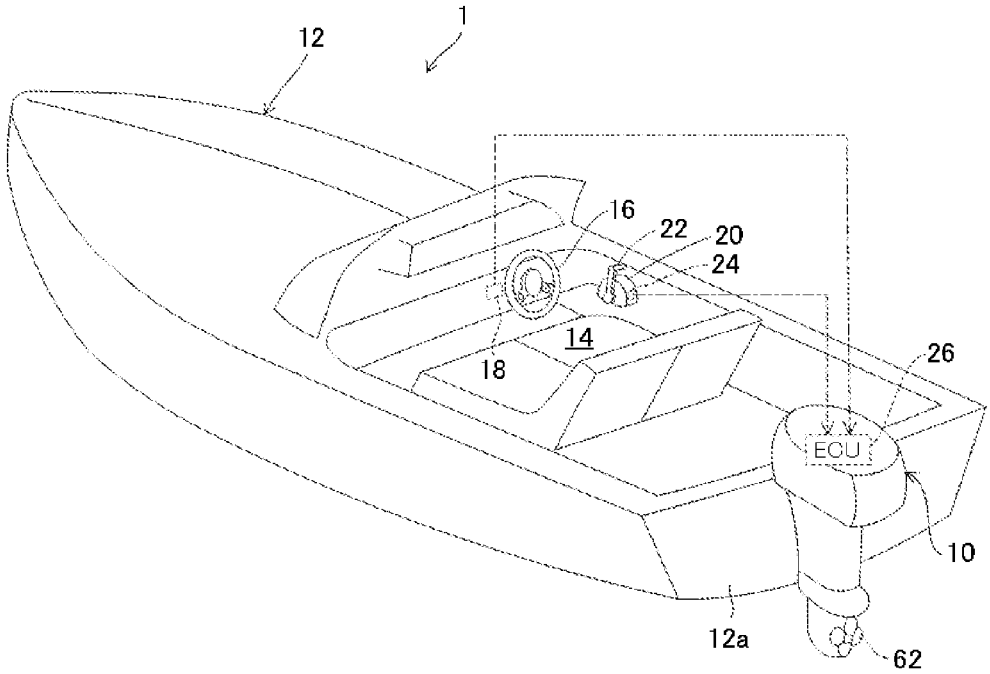
FIG. 1 is an overall schematic view of an outboard motor control apparatus including a boat according to a first embodiment of the invention.
Figure 2:
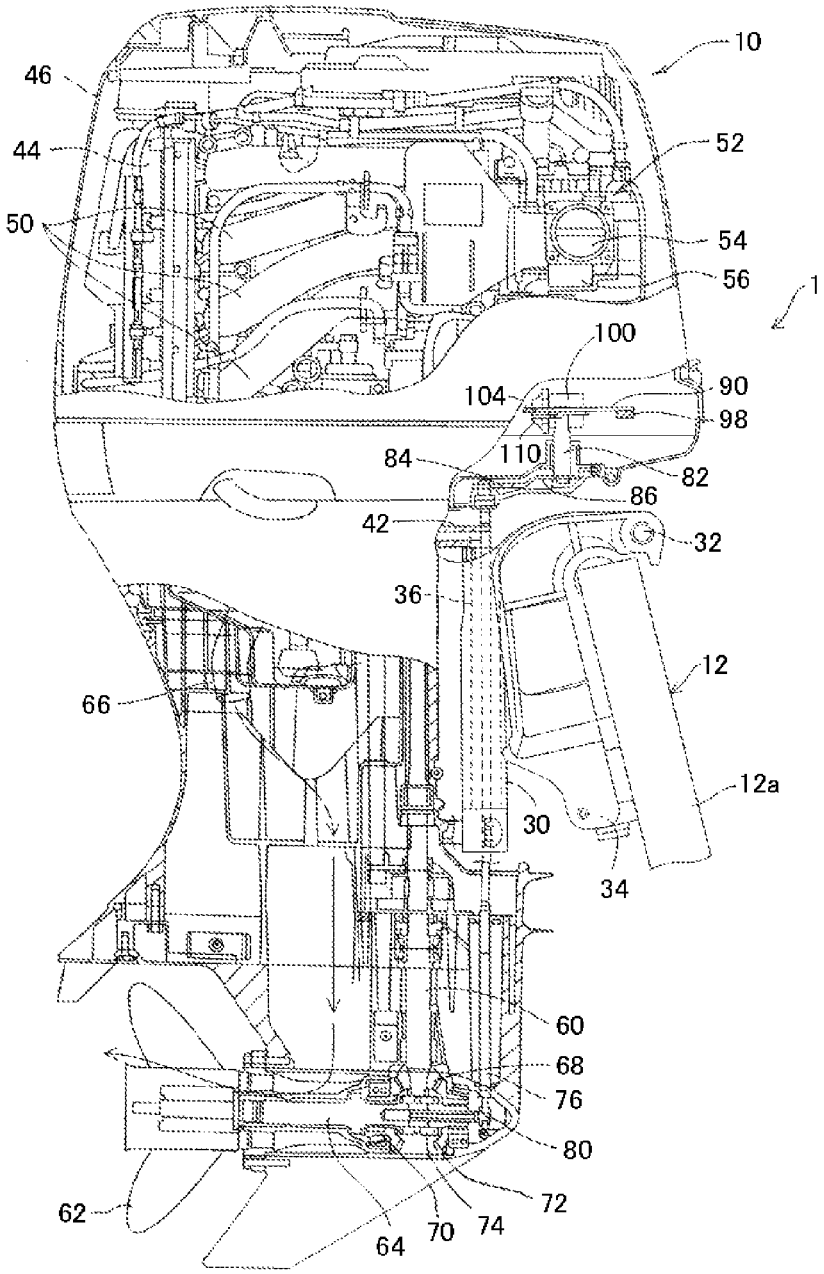
FIG. 2 is an enlarged sectional side view partially showing the outboard motor shown in FIG. 1.

FIG. 1 is an overall schematic view of an outboard motor control apparatus including a boat according to a first embodiment of the invention. FIG. 2 is an enlarged sectional side view partially showing the outboard motor shown in FIG. 1 and FIG. 3 is an enlarged side view of the outboard motor.

Figure 3:
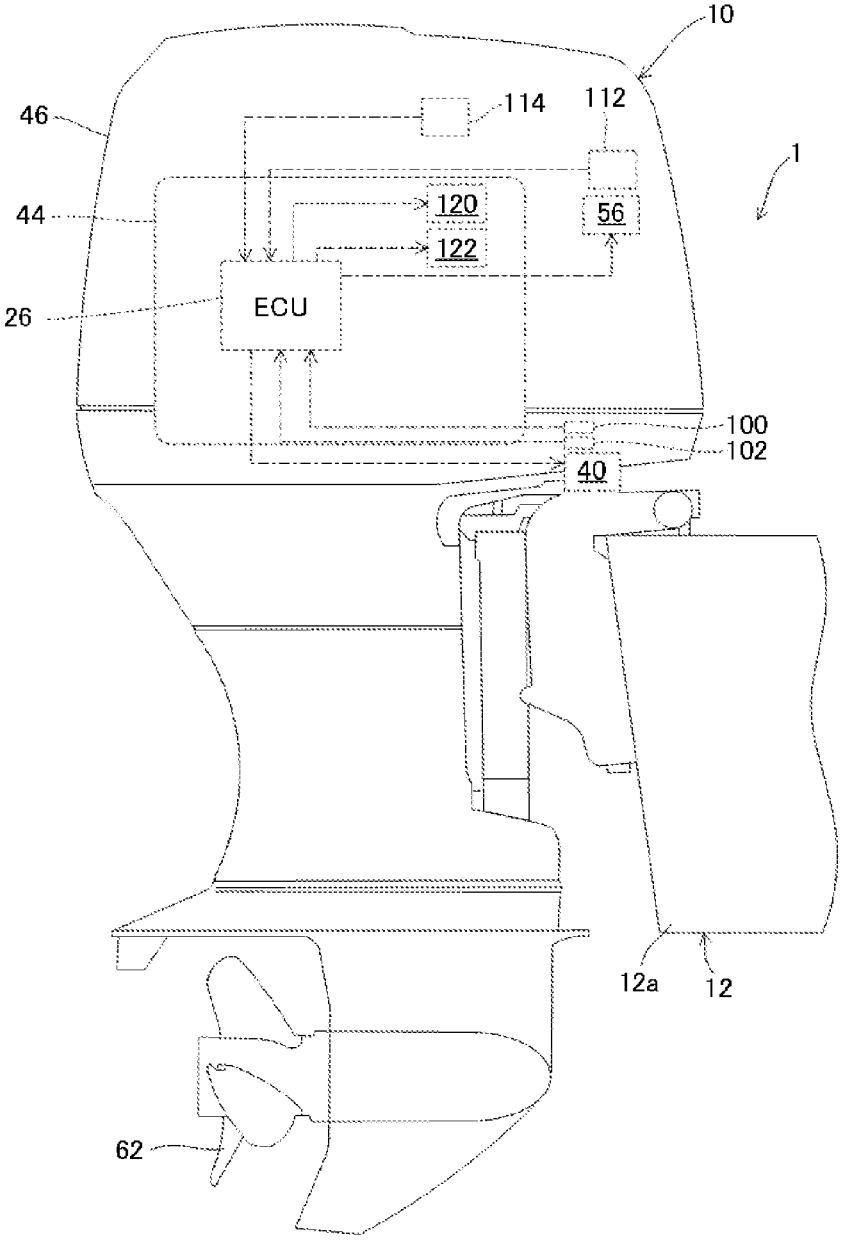
FIG. 3 is an enlarged side view of the outboard motor shown in FIG. 1.

In FIGS. 1 to 3, symbol 1 indicates the boat or vessel whose hull 12 is mounted with the outboard motor 10. The outboard motor 10 is clamped (fastened) to the stern or transom 12*a* of the hull 12.

As shown in FIG. 1, a steering wheel 16 is installed near a cockpit (the operator's seat) 14 of the hull 12 to be manipulated by the operator (not shown). A steering angle sensor 18 is attached on a shaft (not shown) of the steering wheel 16 to produce an output or signal corresponding to the steering angle applied or inputted by the operator through the steering wheel 16.

A remote control box 20 is provided near the cockpit 14 and is equipped with a shift lever (shift/throttle lever) 22 installed to be manipulated by the operator. The lever 22 can be moved or swung in the front-back direction from the initial position and is used to input a shift change command (forward, reverse and neutral switch command) and an engine speed regulation command including an engine acceleration and deceleration command. A lever position sensor 24 is installed in the remote control box 20 and produces an output or signal corresponding to a position of the lever 22.

The outputs of the steering angle sensor 18 and lever position sensor 24 are sent to an Electronic Control Unit (ECU) 26 disposed in the outboard motor 10. The ECU 26 has a microcomputer including a CPU, ROM, RAM and other devices.

As clearly shown in FIG. 2, the outboard motor 10 is fastened to the hull 12 through a swivel case 30, tilting shaft 32 and stern brackets 34.

An electric steering motor (actuator; only shown in FIG. 3) 40 for driving a swivel shaft 36 which is housed in the swivel case 30 to be rotatable about the vertical axis, is installed at the upper portion in the swivel case 30. The rotational output of the steering motor 40 is transmitted to the swivel shaft 36 via a speed reduction gear mechanism (not shown) and mount frame 42, whereby the outboard motor 10 is rotated or steered about the swivel shaft 36 as a steering axis (about the vertical axis) to the right and left directions.

An internal combustion engine (prime mover; hereinafter referred to as the "engine") 44 having a plurality of (more exactly, six) cylinders is disposed at the upper portion of the outboard motor 10. The engine 44 comprises a spark-ignition, V-type, multi(six)-cylinder, gasoline engine with a displacement of 3,500 cc. The engine 44 is located above the water surface and covered by an engine cover 46. An air intake pipe 50 of the engine 44 is connected to a throttle body 52.

The throttle body 52 has a throttle valve 54 installed therein and an electric throttle motor (actuator) 56 for opening and closing the throttle valve 54 is integrally disposed thereto.

The output shaft of the throttle motor 56 is connected to the throttle valve 54 via a speed reduction gear mechanism (not shown). The throttle motor 56 is operated to open and close the throttle valve 54, thereby regulating a flow rate of air sucked in the engine 44.

The outboard motor 10 is equipped with a power source (not shown) such as a battery attached to the engine 44 to supply operating power to the motors 40, 56, etc.

The outboard motor 10 has a drive shaft 60 that is rotatably supported in parallel with the vertical axis and a propeller shaft 64 that is supported to be rotatable about the horizontal axis and attached at its one end with a propeller 62. As indicated by arrows in FIG. 2, exhaust gas emitted from an exhaust pipe 66 of the engine 44 passes near the drive shaft 60 and propeller shaft 64 to be discharged into the water, i.e., to rearward of the propeller 62.

The drive shaft 60 is connected at its upper end with the crankshaft (not shown) of the engine 44 and at its lower end with a pinion gear 68. The propeller shaft 64 is provided with a forward gear (forward bevel gear) 70 and reverse gear (reverse bevel gear) 72 to be rotatable. The forward and reverse gears 70, 72 are engaged (meshed) with the pinion gear 68 to be rotated in the opposite directions. A clutch 74 is installed between the forward and reverse gears 70, 72 to be rotated integrally with the propeller shaft 64.

The clutch 74 is displaced in response to the manipulation of the shift lever 22. When the clutch 74 is engaged with the forward gear 70, the rotation of the drive shaft 60 is transmitted to the propeller shaft 64 through the pinion gear 68 and forward gear 70, so that the propeller 62 is rotated to generate the thrust acting in the direction of making the hull 12 move forward. Thus the forward position is established.

On the other hand, when the clutch 74 is engaged with the reverse gear 72, the rotation of the drive shaft 60 is transmitted to the propeller shaft 64 through the pinion gear 68 and reverse gear 72, so that the propeller 62 is rotated in the opposite direction from the forward moving to generate the thrust acting in the direction of making the hull 12 move backward (reverse). Thus the reverse position is established.

When the clutch 74 is not engaged with any of the forward and reverse gears 70, 72, the rotation of the drive shaft 60 to be transmitted to the propeller shaft 64 is cut off. Thus the neutral position is established.

The configuration that the shift position can be changed by displacing the clutch 74 will be explained in detail. The clutch 74 is connected via a shift slider 80 to the bottom of a first shift shaft 76 that is rotatably supported in parallel with the vertical direction. The upper end of the first shift shaft 76 is positioned in the internal space of the engine cover 46 and a second shift shaft (shift shaft) 82 is disposed in the vicinity of the upper end to be rotatably supported in parallel with the vertical direction.

The upper end of the first shift shaft 76 is attached with a first gear 84, while the bottom of the second shift shaft 82 is attached with a second gear 86. The first and second gears 84, 86 are meshed with each other.

Figure 4:
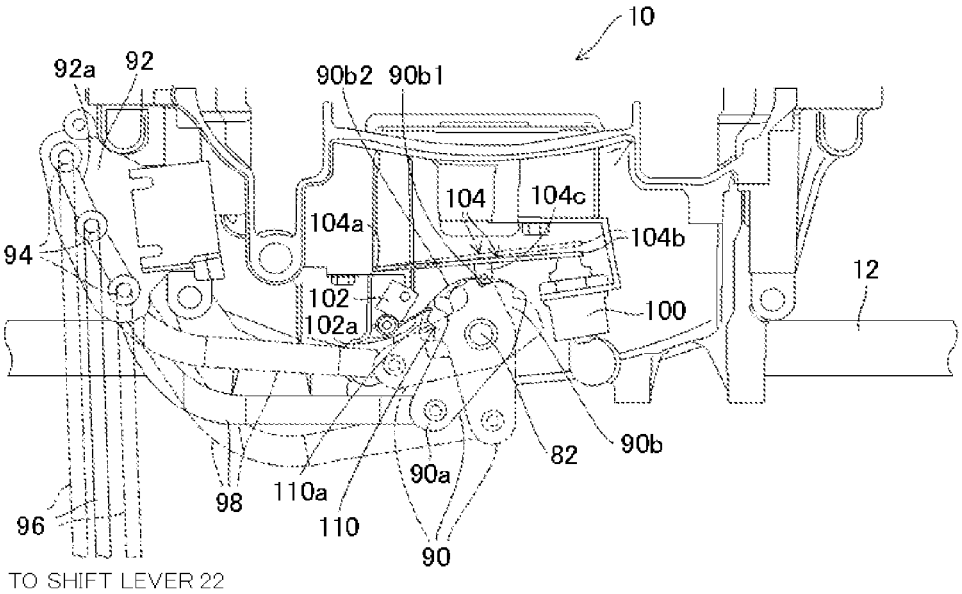
FIG. 4 is a plan view showing a region around a second shift shaft shown in FIG. 2 when viewed from the top.

FIG. 4 is a plan view of a region around the second shift shaft 82 shown in FIG. 2 when viewed from the top. In FIG. 4, the second gear 86 and the like are omitted for ease of understanding and ease of illustration. Further, the drawing of FIG. 4 is defined so that the bottom side on plane of paper is the hull 12 side.

As shown in FIG. 4, the upper end of the second shift shaft 82 is fixed with a shift arm 90. A shift link bracket 92 bored with a long hole 92*a* is installed at an appropriate position of the outboard motor 10 and the long hole 92*a* is movably inserted with a link pin 94.

The link pin 94 is connected to the shift lever 22 of the hull 12 through a push-pull cable 96, and also rotatably connected to one end 90*a* of the shift arm 90 through a link 98 having a substantially L-shape as viewed from the top.

As thus configured, upon the manipulation of the shift lever 22 by the operator, the push-pull cable 96 is operated to move the link pin 94 along the long hole 92*a* and the link 98 is displaced accordingly, so that the shift arm 90 is rotated or swung about the second shift shaft 82 as the rotation axis.

Further explanation is made with reference to FIG. 2. The rotation of the second shift shaft 82 is transmitted through the second gear 86 and first gear 84 to the first shift shaft 76 to rotate it and the rotation of the first shift shaft 76 displaces the shift slider 80 and clutch 74 appropriately, thereby switching the shift position among the forward, reverse and neutral positions, as mentioned above. Note that, in FIG. 4, solid lines indicate the neutral shift position, alternate long and short dashed lines the forward position and alternate long and two short dashed lines the reverse position.

Thus, in response to the manipulation by the operator, the second shift shaft 82 is rotated to engage the clutch 74 with one of the forward and reverse gears 70, 72 to establish the in-gear position (i.e., forward or reverse position) that enables the driving force (output) of the engine 44 to be transmitted to the propeller 62 and to disengage the clutch 74 to establish the neutral position that cuts off the transmission of the driving force, thereby changing the shift position.

A neutral switch (contact switch) 100 and shift switch (contact switch) 102 are disposed near the second shift shaft 82 so that the shaft 82 is arranged between the switches 100, 102.

Figure 5:
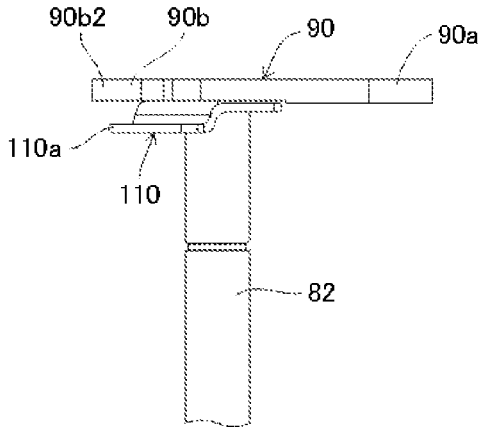
FIG. 5 is an enlarged side view of the second shift shaft, etc., shown in FIG. 2.
Figure 6:
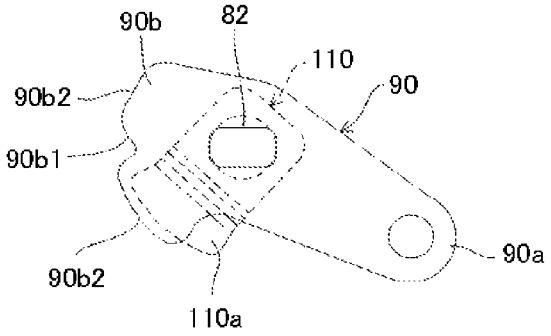
FIG. 6 is an enlarged plan view of the second shift shaft, etc., shown in FIG. 5.

FIG. 5 is an enlarged side view of the second shift shaft 82 and shift arm 90 shown in FIG. 2 and FIG. 6 is an enlarged plan view of the second shift shaft 82 and shift arm 90 shown in FIG. 5.

The explanation will be made with reference to FIGS. 4 to 6. An operating point of the neutral switch 100 for producing an output (ON signal) is set in association with the rotation of the shift arm 90. To be specific, in the shift arm 90, its other end 90*b* positioned across the shift shaft 82 from its one end 90*a* has a substantially circular cam shape as viewed from the top. A plate 104 (shown only in FIG. 4) is disposed to face the other end 90*b* of the shift arm 90.

One end 104*a* of the plate 104 is fixed at an appropriate position of the outboard motor 10 and the other end 104*b* thereof is positioned so that it can make contact with (abut on) the neutral switch 100. A projection (convex) 104*c* is formed in the center of the plate 104 to face the other end 90*b* of the shift arm 90. The plate 104 comprises a sheet spring (elastic material) and is configured so that the projection 104*c* is pressed toward the other end 90*b* of the shift arm 90. As a result, the projection 104*c* is always in contact with the other end 90*b*.

The other end 90*b* of the shift arm 90 is formed with a recess 90*b*1 that can engage with the projection 104*c*. The remaining portion (substantially-circular portion) of the other end 90*b* other than the recess 90*b*1 is hereinafter called the "first circular arc" and assigned by symbol 90*b*2.

The recess 90*b*1 is formed at a position that enables engagement with the projection 104*c* at the time when the rotational angle (rotational position) of the second shift shaft 82 is within a range indicative of the neutral position (e.g., when it is in the condition indicated by the solid lines in FIG. 4). On the other hand, the layout is defined so that the projection 104*c* does not engage with the recess 90*b*1, i.e., so that the projection 104*c* contacts the first circular arc 90*b*2 of the other end 90*b*, at the time when the rotational angle of the second shift shaft 82 is out of the range indicative of the neutral position, more exactly, when it is within a range indicative of the forward or reverse position (e.g., when it is in the condition indicated by the alternate long and short dashed lines or the alternate long and two short dashed lines in FIG. 4).

With the above configuration, when the second shift shaft 82 is rotated in response to the shift lever manipulation by the operator and the rotational angle thereof is within the range indicative of the neutral position, the projection 104*c* of the plate 104 engages with the recess 90*b*1 of the other end 90*b* and it makes the other end 104*b* of the plate 104 move further downward (on plane of paper) to establish contact with the neutral switch 100, whereby the neutral switch 100 produces the ON signal.

When the rotational angle of the second shift shaft 82 is within the range indicative of a position other than the neutral position, since the projection 104*c* is brought into contact with the first circular arc 90*b*2, the other end 104*b* of the plate 104 is moved backward as indicated by the alternate long and short dashed lines in FIG. 4 and consequently, it has no contact with the neutral switch 100, whereby the neutral switch 100 does not produce the output (ON signal), i.e., is made OFF. Thus the shift arm 90 also functions as a cam used for operating the neutral switch 100.

Figure 7:
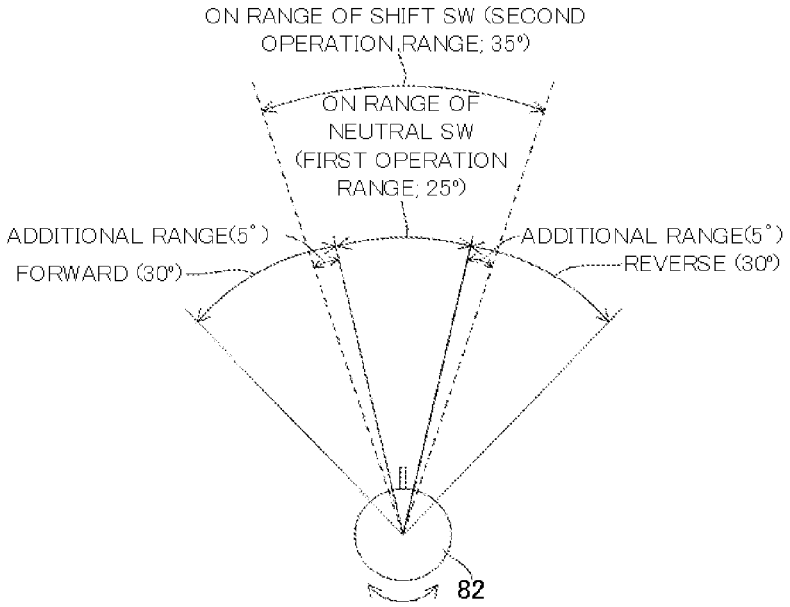
FIG. 7 is an explanatory view for explaining operation ranges (ON ranges) in which a neutral switch and shift switch shown in FIG. 4 output ON signals.

FIG. 7 is an explanatory view for explaining operation ranges (ON ranges) in which the neutral switch 100 and shift switch 102 output the ON signals. It should be noted that, in FIG. 7, the second shift shaft 82 is provided with a protrusion for ease of understanding of the rotational angle (rotational position) and the protrusion does not exist in fact.

As shown in FIG. 7, the range of the rotational angle of the second shift shaft 82 indicative of the neutral position, i.e., the range in which the neutral switch 100 outputs the ON signal, is called the "first operation range" and set to about 25 degrees. The second shift shaft 82 is designed to be rotatable in a range defined by adding about 30 degrees on both sides of the first operation range indicative of the neutral position, more exactly, in a range of about 85 degrees that includes about 30 degrees on the forward side and about 30 degrees on the reverse side.

The explanation on the shift switch 102 will be made with reference to FIGS. 4 to 6. The operating point of the shift switch 102 for producing an output (ON signal) is set in association with the operation of a cam 110 that is provided for changing the shift position. The cam 110 is installed under the shift arm 90 of the second shift shaft 82 to be coaxially therewith.

To be specific, the cam 110 is fixed to the second shift shaft 82 and formed with a second circular arc 110*a* having a substantially circular shape as viewed from the top. A switch section 102*a* is located near the second circular arc 110*a* and upon being contacted with (pressed by) the circular arc 110*a*, operates the shift switch 102 to output the ON signal.

The second circular arc 110*a* is designed so that it contacts the switch section 102*a* when the rotational angle of the second shift shaft 82 is within a second operation range including the first operation range and additional ranges successively added on the both sides thereof.

The second operation range will be explained with reference to FIG. 7. The first operation range is added at its both sides with the additional ranges, each of which is about 5 degrees for instance, and a total of the first operation range (25 degrees) and additional ranges (5 degrees each), i.e., the range of 35 degrees in total is defined as the "second operation range."

As a result, when the second shift shaft 82 is rotated in response to the manipulation of the shift lever 22 by the operator and its rotational angle is within the second operation range, the second circular arc 110*a* of the cam 110 contacts (presses) the switch section 102*a* of the shift switch 102, so that the shift switch 102 produces the ON signal. In contrast, when the rotational angle is out of the second operation range, the second circular arc 110*a* of the cam 110 does not make contact with the switch section 102*a* of the shift switch 102 and the shift switch 102 produces no output (no ON signal), i.e., is made OFF, accordingly.

As mentioned in the foregoing, the neutral switch 100 produces the output when the rotational angle of the second shift shaft 82 is within the first operation range indicative of the neutral position, while the shift switch 102 produces the output when the rotational angle of the second shift shaft 82 is within the second operation range including the first operation range and the additional ranges successively added to the both sides of the first operation range.

As shown in FIG. 3, a throttle opening sensor 112 is installed near the throttle valve 54 to produce an output or signal indicative of a throttle opening TH [degree]. A crank angle sensor 114 is disposed near the crankshaft of the engine 44 and produces a pulse signal at every predetermined crank angle. The aforementioned outputs of the switches and sensors are sent to the ECU 26.

Based on the received sensor outputs, the ECU 26 controls the operation of the steering motor 40 to steer the outboard motor 10. Further, based on the received outputs of the lever position sensor 24, etc., the ECU 26 controls the operation of the throttle motor 56 to open and close the throttle valve 54, thereby regulating the throttle opening TH.

Furthermore, based on the sensor outputs and switch outputs, the ECU 26 determines the fuel injection amount and ignition timing of the engine 44, so that fuel of the determined fuel injection amount is supplied through an injector 120 (shown in FIG. 3) and the air-fuel mixture composed of the injected fuel and intake air is ignited by an ignition device 122 (shown in FIG. 3) at the determined ignition timing.

Thus, the outboard motor control apparatus according to the embodiments is a Drive-By-Wire type apparatus whose operation system (steering wheel 16, shift lever 22) has no mechanical connection with the outboard motor 10, except the configuration related to the shift position change.

Figure 8:
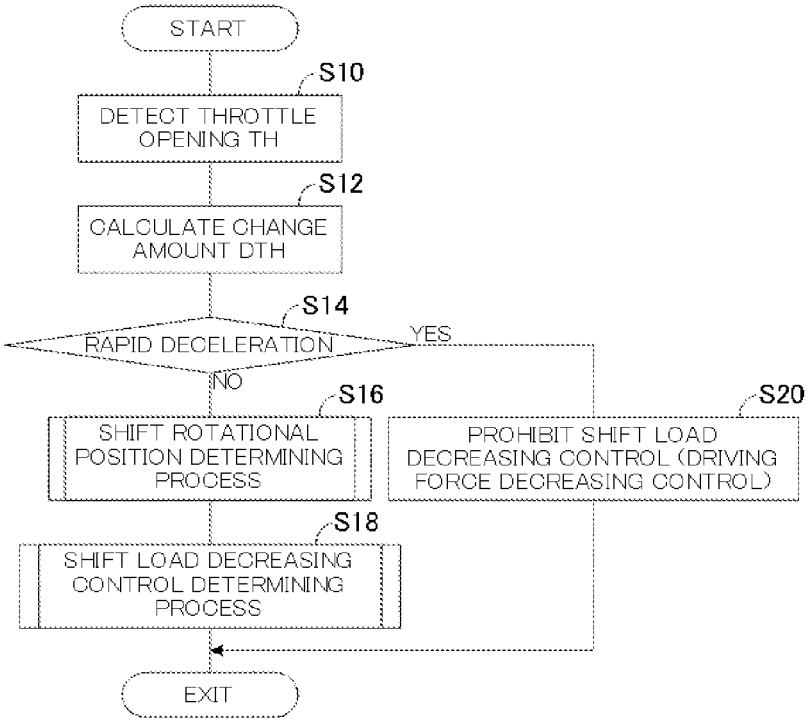
FIG. 8 is a flowchart showing an engine control operation executed by an Electronic Control Unit (ECU) shown in FIG. 1.

FIG. 8 is a flowchart showing the engine control operation by the ECU 26. The illustrated program is executed at predetermined intervals, e.g., 100 milliseconds.

The program begins at S10, in which the throttle opening TH is detected or calculated from the output of the throttle opening sensor 112. The program proceeds to S12, in which a change amount DTH of the detected throttle opening TH per a predetermined time period (e.g., 500 milliseconds) is calculated.

Next the program proceeds to S14, in which it is determined whether the deceleration (more precisely, rapid deceleration) is instructed to the engine 44 by the operator, i.e., whether the engine 44 is in the operating condition to (rapidly) decelerate the boat 1, when the shift position is in the forward position.

Specifically, when the output indicating that the shift lever 22 is in the forward position is outputted by the lever position sensor 24, the throttle opening change amount DTH calculated in S12 is compared to a predetermined value DTHa used for deceleration determination and when the change amount DTH is equal to or less than the predetermined value DTHa, it is discriminated that the throttle valve 54 is rapidly operated in the closing direction, i.e., the rapid deceleration is instructed. The predetermined value DTHa (negative value) is set as a criterion for determining whether the rapid deceleration is instructed, e.g., −20 degrees.

When the result in S14 is negative, the program proceeds to S16, in which a shift rotational position determining process for determining the present rotational angle of the second shift shaft 82, i.e., the rotational position thereof (hereinafter sometimes called the "shift rotational position") in the present program loop, is performed.

Figure 9:
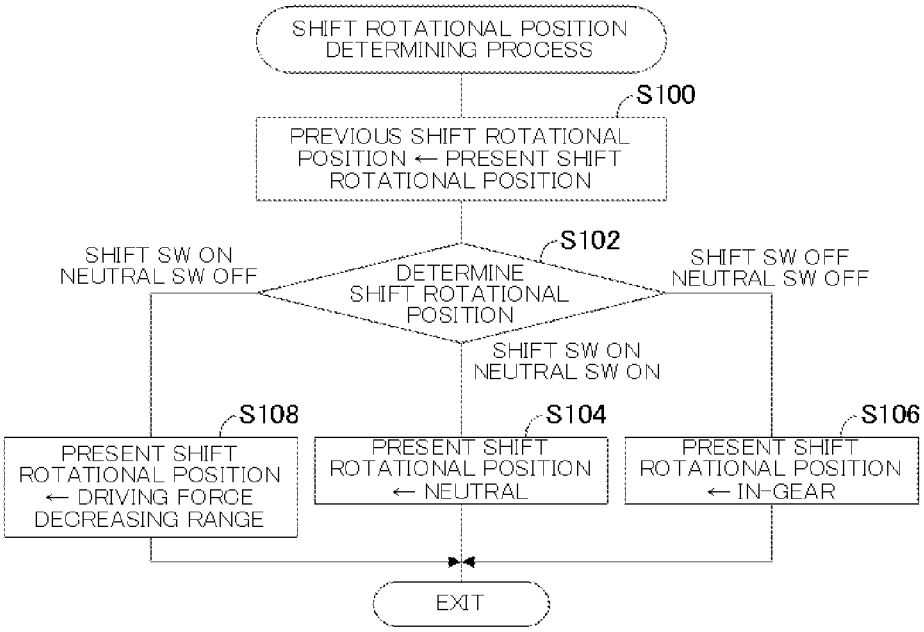
FIG. 9 is a subroutine flowchart showing a shift rotational position determining process shown in FIG. 8.

FIG. 9 is a subroutine flowchart showing the process. As illustrated, in S100, a present shift rotational position (described later) set in the previous program loop is defined as a previous shift rotational position, i.e., the previous shift rotational position is updated.

Next the program proceeds to S102, in which the rotational position of the second shift shaft 82 is determined based on the outputs of the neutral switch 100 and shift switch 102. Specifically, when the neutral switch 100 and shift switch 102 both produce the outputs (ON signals), it is discriminated that the rotational position of the shift shaft 82 (i.e., the rotational position (angle) of the protrusion of the shift shaft 82 shown in FIG. 7) is within the first operation range and the shift position is in the neutral position. Then the program proceeds to S104, in which the present shift rotational position is set as the "neutral."

When, in S102, the neutral switch 100 and shift switch 102 both produce no output, i.e., are both made OFF, it is discriminated that the rotational position of the shift shaft 82 is out of the second operation range and the shift position is in the in-gear position, and the program proceeds to S106, in which the present shift rotational position is set as the "in-gear."

Further, when the shift switch 102 produces the output (ON signal) and the neutral switch 100 produces no output, the rotational position of the shift shaft 82 is determined to be within the additional ranges shown in FIG. 7 and the program proceeds to S108, in which the present shift rotational position is set as a "driving force decreasing range." It is called the "driving force decreasing range" because, when the shift shaft 82 is within the additional ranges, there may be a need to perform shift load decreasing control to decrease the driving force of the engine 44 for mitigating load on the operator caused by the shift lever manipulation, as described later.

Returning to the explanation on FIG. 8, the program proceeds to S18, in which a shift load decreasing control determining process is conducted for determining whether the shift load decreasing control is to be performed.

Figure 10:
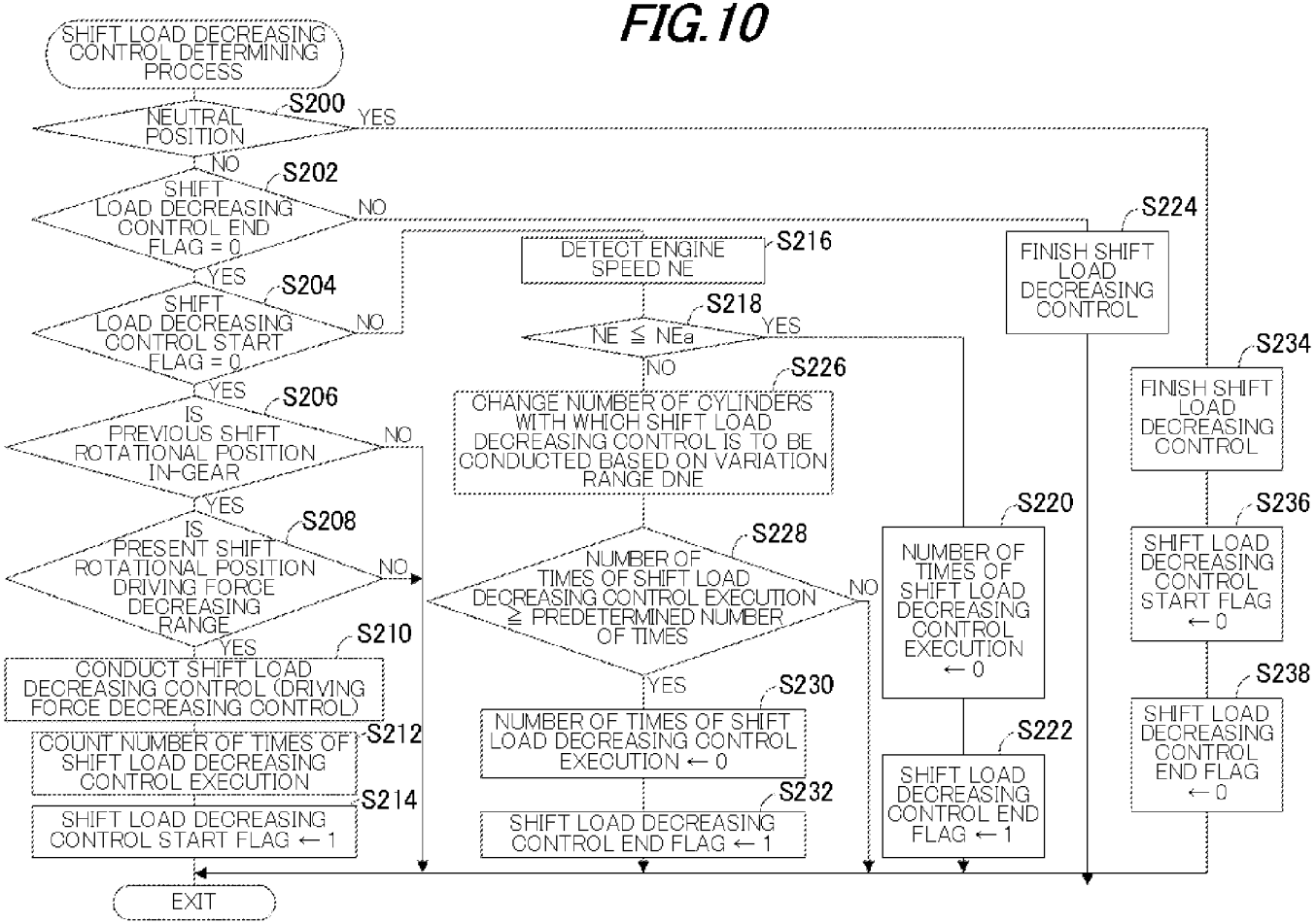
FIG. 10 is a subroutine flowchart showing a shift load decreasing control determining process shown in FIG. 8.

FIG. 10 is a subroutine flowchart showing the process.

As shown in FIG. 10, in S200, it is determined based on the output of the neutral switch 100 whether the present shift position is in the neutral position. When the result in S200 is negative, the program proceeds to S202, in which it is determined whether the bit of a shift load decreasing control end flag (described later) is 0.

Since the initial value of this flag is 0, the result in S202 in the first program loop is generally affirmative and the program proceeds to S204, in which it is determined whether the bit of a shift load decreasing control start flag (described later) is 0.

Since the initial value of this flag is also 0, the result in S204 in the first program loop is generally affirmative and the program proceeds to S206, in which it is determined whether the previous shift rotational position is the in-gear, i.e., whether the shift position in the previous program loop is in the forward or reverse position.

When the result in S206 is negative, the remaining steps are skipped, while when the result is affirmative, the program proceeds to S208, in which it is determined whether the present shift rotational position is the driving force decreasing range. When the result in S208 is negative, the program is terminated, while when the result is affirmative, i.e., when the shift lever 22 is manipulated by the operator so that the shift rotational position is changed from the in-gear to the driving force decreasing range (in other words, when the neutral operation in which the shift position is switched from the in-gear position to the neutral position is detected based on the outputs of the neutral switch 100 and shift switch 102), the program proceeds to S210, in which the shift load decreasing control (sometimes called the "driving force decreasing control") to decrease the driving force of the engine 44 for mitigating load on the operator caused by manipulation of the shift lever 22, is conducted or started.

To be more specific, in S210, the ignition is cut off, the ignition timing is retarded (e.g., 10 degrees), or the fuel injection amount is decreased in the engine 44, i.e., at least one of those operations is conducted, to decrease the driving force of the engine 44, more specifically, to change the engine speed NE so as to gradually decrease it. Consequently, it makes easy to release the engagement of the clutch 74 with the forward or reverse gear 70 or 72, thereby mitigating load on the operator caused by the shift lever manipulation.

Note that, in S210, in the case of the ignition cut-off or retarding of ignition timing, it is carried out from a cylinder associated with the next ignition, while in the case of the decrease of fuel injection amount, it is carried out from a cylinder associated with the next injection.

Next the program proceeds to S212, in which the number of times that the shift load decreasing control through the ignition cut-off or the like is executed is counted, and to S214, in which the bit of the shift load decreasing control start flag is set to 1. Specifically, the bit of this flag is set to 1 when the shift load decreasing control is started and otherwise, reset to 0.

In a program loop after the bit of the shift load decreasing control start flag is set to 1, the result in S204 is negative and the program proceeds to S216. In S216, the output pulses of the crank angle sensor 114 are counted to detect or calculate the engine speed NE and then in S218, it is determined whether the detected engine speed NE is equal to or less than a limit value (stall limit engine speed (predetermined engine speed) NEa) with which the engine 44 can avoid a stall. The stall limit engine speed NEa is set, for instance, the same as a threshold value used for determining whether a starting mode should be changed to a normal mode in the normal operation control of the engine 44, more exactly, set to 500 rpm.

When the result in S218 is affirmative, the program proceeds to S220, in which a counter value indicating the number of times of the shift load decreasing control execution is reset to 0, and to S222, in which the bit of the shift load decreasing control end flag is set to 1.

When the bit of this flag is set to 1, the result in S202 in the next program loop becomes negative and the program proceeds to S224, in which the shift load decreasing control is finished. Specifically, when the engine speed NE is equal to or less than the stall limit engine speed NEa, if the shift load decreasing control, i.e., the control to decrease the driving force of the engine 44 through the ignition cut-off, etc., is continued, it may cause a stall of the engine 44. Therefore, in this case, the shift load decreasing control is stopped regardless of the shift rotational position.

On the other hand, when the result in S218 is negative, the program proceeds to S226, in which a variation range (change amount) DNE of the engine speed NE is detected during execution of the shift load decreasing control and based on the detected variation range DNE, out of the plurality of the cylinders, the number of cylinders with which the shift load decreasing control should be conducted is determined and changed.

More specifically, the variation range DNE (a difference between the maximum and minimum engine speeds in one ignition cycle) is detected or calculated every ignition cycle of a specific cylinder with which the shift load decreasing control is first conducted, and the number of cylinders with which the shift load decreasing control should be conducted is determined and changed by retrieving mapped data shown in FIG. 11 using the detected variation range DNE. The number of cylinders is changed at the timing of the next ignition or next fuel injection.

As can be seen in FIG. 11, the number of cylinders is set to decrease with increasing variation range DNE. More precisely, when the variation range DNE is below 200 rpm, i.e., relatively small, the shift load decreasing control through the ignition cut-off or the like is performed with three cylinders out of a plurality of (six) cylinders.

Note that, in the engine 44 of V-type and having the six cylinders in this embodiment, it is configured so that the above three cylinders with which the shift load decreasing control is to be conducted are those of a cylinder bank containing the specific cylinder with which the control is first conducted in S210. For instance, in the case where the shift load decreasing control is first conducted with a cylinder in the right bank, the control is conducted with three cylinders of the right bank while the other three cylinders in the left bank are operated under the normal control. Or, when the shift load decreasing control is performed by retarding the ignition timing of the right bank, the ignition timing of the left bank may be advanced.

Since the combustion stroke of such a V-type, six-cylinder engine is carried out alternately in the right and left banks, when the three cylinders to be conducted with the shift load decreasing control are defined as mentioned above, it means that the execution and inexecution of the control are alternately made in the engine 44. As a result, the engine speed NE can be sharply changed with no time lag, thereby effectively mitigating load on the operator caused by the shift lever manipulation.

In the case where the engine 44 is of in-line, six-cylinder type, the first to sixth cylinders arranged in order are divided into a group including the first to third cylinders and the other group including the fourth to sixth cylinders and three cylinders in one of the two groups are conducted with the shift load decreasing control. Specifically, when the shift load decreasing control is first conducted with the first cylinder in S210 for example, three cylinders of one group including the first cylinder are conducted with the control, while the fourth to sixth cylinders in the other group are operated under the normal control (similarly to the aforementioned case, when the ignition timing of the one group including the first to third cylinders is retarded, the ignition timing of the other group including the fourth to sixth cylinders may be advanced). With this, the same effect can be achieved also in the in-line, six-cylinder engine.

As shown in FIG. 11, the shift load decreasing control is conducted with two cylinders when the variation range DNE of the engine speed NE is at or above 200 rpm and below 300 rpm and with one cylinder when it is at or above 300 rpm and below 400 rpm. When the variation range DNE is at or above a predetermined variation range (e.g., 400 rpm), i.e., relatively large, since it may cause the engine stall due to the shift load decreasing control, the number of cylinders is set to 0, in other words, the control is stopped.

Next the program proceeds to S228, in which it is determined whether the number of times of the shift load decreasing control execution is equal to or greater than a predetermined number of times (described later). When the result in S228 is negative, the remaining steps are skipped, while when the result is affirmative, the program proceeds to S230, in which the counter value indicating the number of times of the shift load decreasing control execution is reset to 0, and to S232, in which the bit of the shift load decreasing control end flag is set to 1. Consequently, the result in S202 in the next program loop becomes negative and the program proceeds to S224, in which the shift load decreasing control is finished.

The processing of S228 to S232 is conducted for preventing the shift load decreasing control from being executed for a long time. Specifically, depending on movement of the shift lever 22, for example when the shift lever 22 is slowly manipulated, the rotational position of the second shift shaft 82 may remain in the driving force decreasing range for a relatively long time. In this case, if the control such as the ignition cut-off is continued, it could make the operation of the engine 44 (combustion condition) unstable, i.e., make the engine speed NE unstable, disadvantageously.

Therefore, the apparatus according to this embodiment is configured to finish (stop) the shift load decreasing control when it is discriminated that the load on the operator caused by the shift lever manipulation has been sufficiently mitigated through the control (more exactly, when about two seconds have elapsed since the control started). The predetermined number of times is set as a criterion for determining whether the load on the operator caused by the shift lever manipulation is sufficiently mitigated and also determining that the engine 44 operation may become unstable when the ignition cut-off, etc., is executed the number of times at or above this value, e.g., set to 10 times.

When the shift lever 22 is manipulated by the operator and the change of the shift position to the neutral position is completely done, the result in S200 is affirmative and the program proceeds to S234, in which the shift load decreasing control is finished and to S236 and S238, in which the bits of the shift load decreasing control start flag and shift load decreasing control end flag are both reset to 0, whereafter the program is terminated. Note that, when the shift position is in the neutral position, the operation of the throttle motor 56 is controlled in another program (not shown) so that the engine speed NE is maintained at the idling speed.

Returning to the explanation on FIG. 9, when the result in S14 is affirmative, the program proceeds to S20, in which the shift load decreasing control is prohibited, i.e., when the deceleration (precisely, the rapid deceleration) is instructed to the engine 44 by the operator with the shift position being in the forward position, the above control is not conducted.

Figure 12:
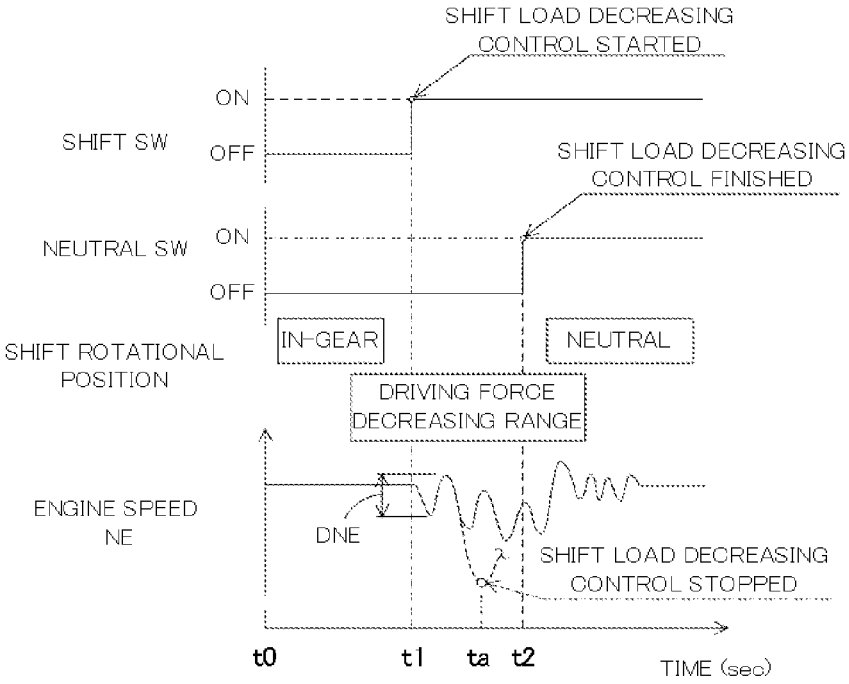
FIG. 12 is a time chart for explaining a part of the processes in FIGS. 8 to 10.

FIG. 12 is a time chart for explaining a part of the foregoing processes in FIGS. 8 to 10. FIG. 12 shows the case where the shift rotational position is moved from the forward (in-gear), via the driving force decreasing range, to the neutral.

As shown in FIG. 12, from the time t0 to t1, since the neutral switch 100 and shift switch 102 both produce no output (i.e., are both made OFF), the rotational position of the second shift shaft 82 is determined to be the in-gear (S106).

When the shift lever 22 is manipulated from the forward position to the neutral position and, at the time t1, the shift rotational position is moved from the in-gear to the driving force decreasing range so that the shift switch 102 is made ON and the neutral switch 100 remains OFF, i.e., when the neutral operation is detected, the shift load decreasing control for decreasing the driving force of the engine 44 is started (S108, S206 to S210). Then, during execution of the shift load decreasing control, based on the variation range DNE of the engine speed NE, the number of cylinders with which the control should be conducted is determined and changed (S226). As a result, the engine speed NE is changed and gradually decreased. Consequently, it makes easy to release the engagement of the clutch 74 with the forward gear 70, thereby mitigating the load on the operator caused by the shift lever manipulation.

Then the shift lever 22 is further manipulated to the neutral position. When, at the time t2, the shift rotational position is moved from the driving force decreasing range to the neutral and the neutral switch 100 and shift switch 102 both produce the outputs (ON signals), the shift load decreasing control is finished (S200, S234).

As indicated by the imaginary lines in FIG. 12, in the case where, for instance, the variation range DNE of the engine speed NE is increased during the period from the time t1 to t2 after the shift load decreasing control is started and, at the time ta, it reaches or exceeds the predetermined variation range, the shift load decreasing control is stopped (S226).

As mentioned in the foregoing, the first embodiment is configured to have an apparatus or method for controlling operation of an outboard motor 10 having an internal combustion engine 44 equipped with a plurality of cylinders, the outboard motor 10 being configured to switch a shift position between an in-gear position that enables driving force of the engine 44 to be transmitted to a propeller 62 by engaging a clutch 74 with one of a forward gear 70 and a reverse gear 72 and a neutral position that cuts off transmission of the driving force by disengaging the clutch 74 from the forward or reverse gear 70, 72, comprising: a neutral operation detector (ECU 26, S16, S18, S100 to S108, S206, S208) adapted to detect a neutral operation in which the shift position is switched from the in-gear position to the neutral position; a driving force controller (ECU 26, S18, S210) adapted to conduct driving force decreasing control (shift load decreasing control) to decrease the driving force of the engine 44 when the neutral operation is detected; and a cylinder number changer (ECU 26, S18, S226) adapted to detect a variation range DNE of a speed of the engine NE during the driving force decreasing control and determine and change number of the cylinders with which the driving force decreasing control is to be conducted out of the plurality of the cylinders based on the detected variation range DNE.

Since the driving force decreasing control to decrease the driving force of the engine 44 is conducted when the neutral operation in which the shift position is switched from the in-gear position to the neutral position is detected, it makes easy to release the engagement of the clutch 74 with the forward or reverse gear 70 or 72 (in-gear condition), thereby mitigating the shift lever manipulation load.

Further, it is configured so that the variation range DNE of the engine speed NE is detected during (execution of) the shift load decreasing control and based on the detected variation range DNE, out of the plurality of the cylinders, the number of cylinders with which the driving force decreasing control should be conducted is determined and changed. With this, it becomes possible to appropriately conduct the driving force decreasing control. Specifically, even when the variation range DNE becomes excessive due to the driving force decreasing control, the number of cylinders with which the control is to be conducted is suitably decreased so that the variation range DNE can be suppressed (i.e., the engine operation can be stabilized), while preventing the engine stall.

In the apparatus, the neutral operation detector includes: a shift shaft (second shift shaft) 82 adapted to be rotated in response to manipulation by an operator to switch the shift position between the in-gear position and the neutral position; a neutral switch 100 adapted to produce an output when a rotational angle of the shift shaft 82 is within a first operation range indicative of the neutral position; and a shift switch 102 adapted to produce an output when the rotational angle of the shift shaft 82 is within a second operation range including the first operation range and additional ranges successively added to both sides of the first operation range, and detects the neutral operation based on the outputs of the neutral switch 100 and the shift switch 102 (S16, S18, S100 to S108, S206, S208). With this, since it is discriminated that the neutral operation is done when the shift switch 102 produces the output and the neutral switch 100 produces no output, the neutral operation can be accurately detected with the simple structure.

In the apparatus, the neutral operation detector determines that the neutral operation is conducted when the shift switch 102 produces the output while the neutral switch 100 produces no output (S16, S18, S100, S108, S206, S208). With this, the neutral operation can be detected more accurately.

In the apparatus, the neutral switch 100 and the shift switch 102 are positioned to be able to contact with a cam (shift arm 90, cam 110) installed coaxially with the shift shaft 82 and produce the outputs upon contacting with the cam 90, 110. With this, the neutral switch 100 and shift switch 102 can be configured to be simple.

The apparatus further includes: a deceleration instruction determiner (throttle opening sensor 112, ECU 26, S14) adapted to determine whether deceleration is instructed to the engine 44 by the operator; and a driving force decreasing control prohibitor (ECU 26, S20) adapted to prohibit the driving force decreasing control when the deceleration is determined to be instructed. With this, it becomes possible to prevent occurrence of so-called water hammer that may be caused by suction of water through the exhaust pipe 66.

To be more specific, in the case where the shift lever 22 is swiftly manipulated toward the reverse side (i.e., the (rapid) deceleration is instructed to the engine 44) with the shift position in the forward position (i.e., with the clutch 74 engaged with the forward gear 70), if the driving force decreasing control is executed at that time, it makes easy to release the engagement with the forward gear 70 (in-gear condition) and accordingly, the shift position is rapidly changed from the forward position to the reverse position at once. In this case, the clutch 74 is sometimes engaged with the reverse gear 72 with the propeller 62 still rotating in the forward direction and it may lead to the reverse rotation of the engine 44, so that water is sucked through the exhaust pipe 66. As a result, the water hammer occurs and it may give damages to the engine 44. However, since this embodiment is configured to prohibit the driving force decreasing control as mentioned above, the engagement with the forward gear 70 is not easily released and it makes possible to delay the timing of shift position change to the reverse position, thereby preventing occurrence of the water hammer.

In the apparatus, the driving force controller decreases the driving force of the engine 44 by conducting at least one of ignition cut-off, ignition timing retarding and decrease of a fuel injection amount in the engine 44 (S210). With this, the driving force of the engine 44 can be reliably decreased, thereby effectively mitigating the shift lever manipulation load.

In the apparatus, the cylinder number changer decreases the number of the cylinders with which the driving force decreasing control is to be conducted as the detected variation range DNE of the engine speed is increased (S18, S226). With this, the driving force decreasing control can be conducted more reliably. Specifically, when, for instance, the variation range DNE is increased due to the driving force decreasing control, since the number of cylinders with which the control is to be conducted is suitably decreased so that the variation range DNE can be suppressed (i.e., the engine 44 operation can be stabilized), it becomes possible to prevent the engine stall more reliably.

The apparatus includes: a driving force decreasing control stopper (ECU 26, S18, S218 to S224, S228 to S232) adapted to stop the driving force decreasing control when the engine speed NE becomes equal to or less than a predetermined engine speed (stall limit engine speed NEa) after the driving force decreasing control is conducted or when the driving force decreasing control is conducted a predetermined number of times or more. With this, even when, for instance, the shift lever 22 is slowly manipulated from the in-gear position to the neutral position, the driving force decreasing control can be stopped before the engine 44 operation becomes unstable, i.e., it becomes possible to avoid longer execution of the driving force decreasing control than necessary. In other words, the driving force decreasing control can be appropriately conducted, while avoiding unstable operation of the engine 44.

An outboard motor control apparatus according to a second embodiment will be next explained.

The explanation of the second embodiment will focus on the points of difference from the first embodiment. In the second embodiment, the shift switch 102 and cam 110 are removed and instead, a shift sensor 103 which detects the rotational angle of the second shift shaft 82 is provided so that the neutral operation is detected based on the outputs of the neutral switch 100 and shift sensor 103.

Figure 13:
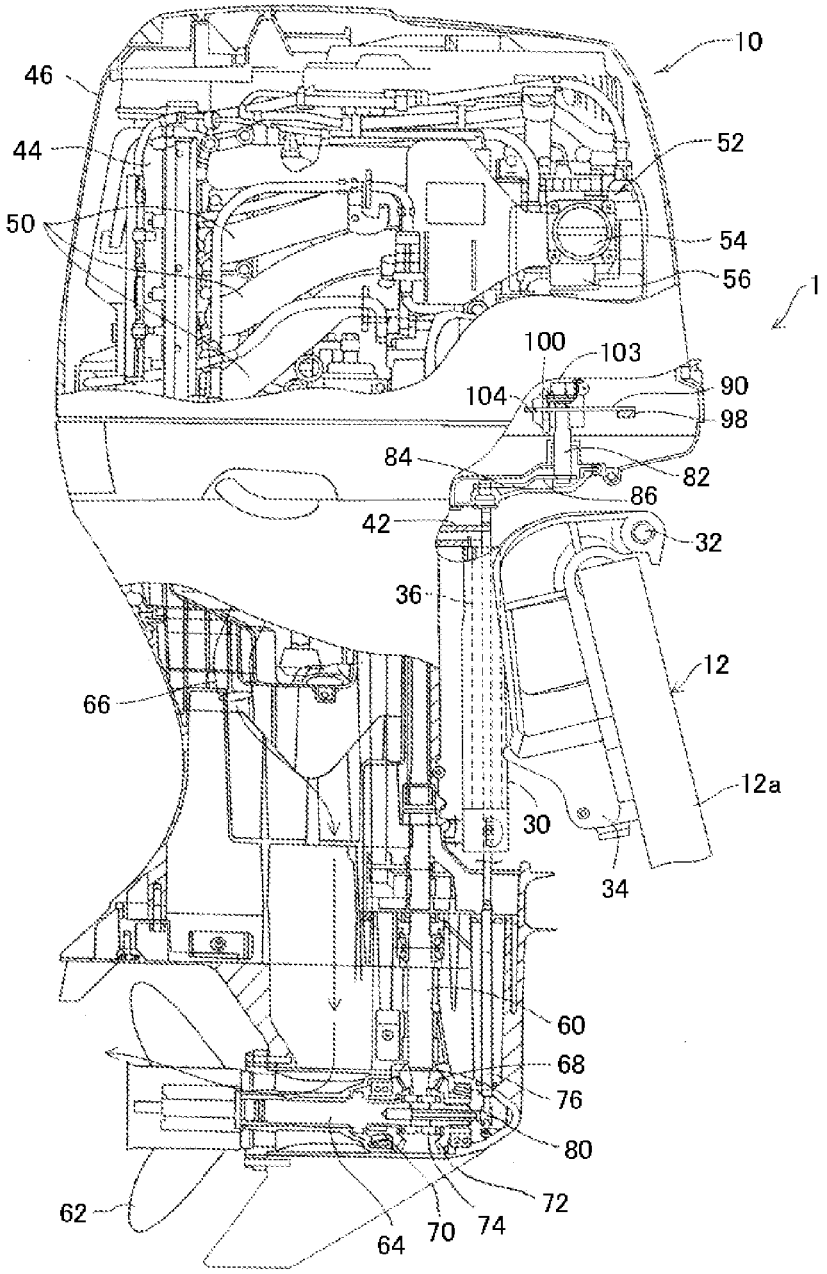
FIG. 13 is an enlarged sectional side view similar to FIG. 2, but partially showing an outboard motor to which an outboard motor control apparatus according to a second embodiment of the invention is applied.
Figure 14:
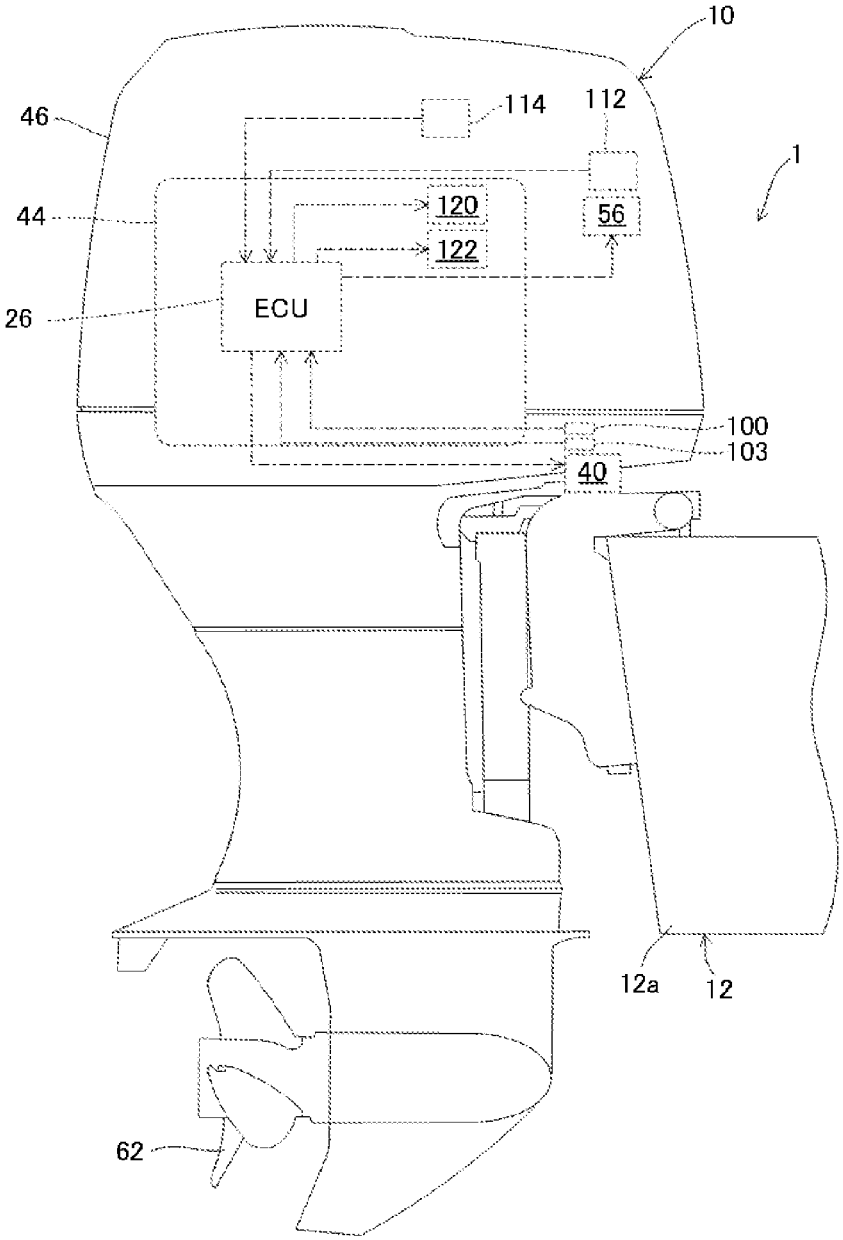
FIG. 14 is an enlarged side view similar to FIG. 3, but showing the outboard motor shown in FIG. 13.
Figure 15:
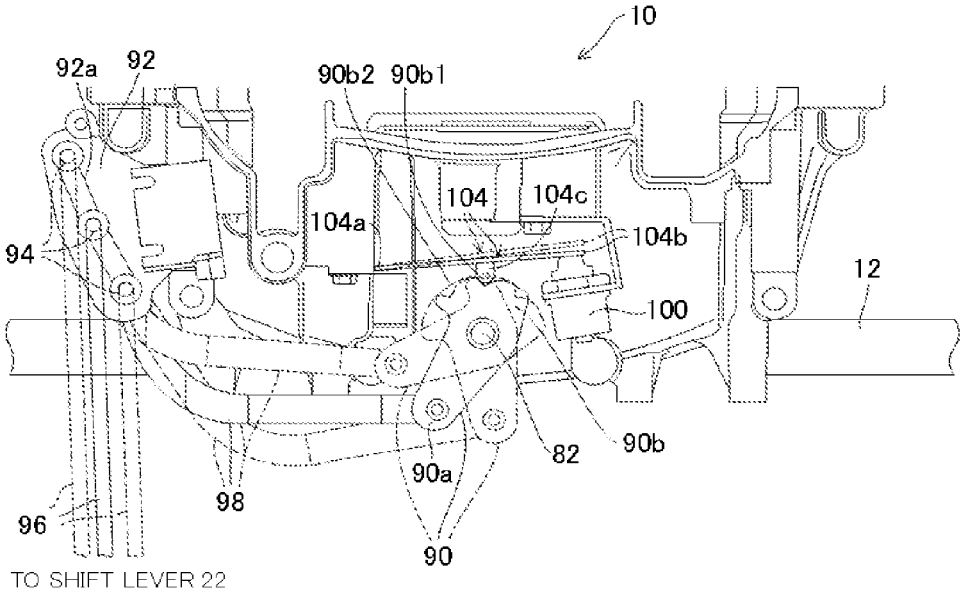
FIG. 15 is a plan view similar to FIG. 4, but showing a region around a second shift shaft shown in FIG. 13 when viewed from the top.
Figure 16:
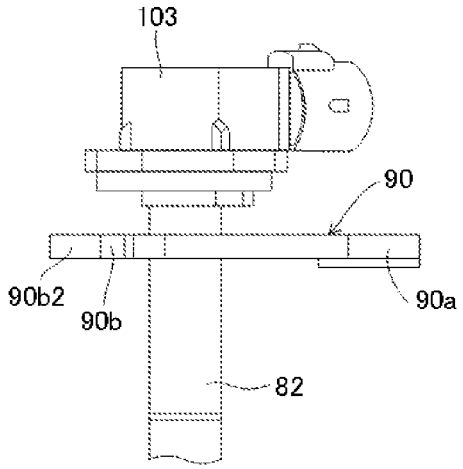
FIG. 16 is an enlarged side view similar to FIG. 5, but showing the second shift shaft, etc., shown in FIG. 13.
Figure 17:
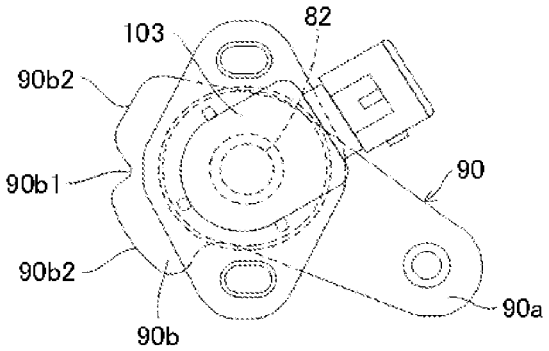
FIG. 17 is an enlarged plan view similar to FIG. 6, but showing the second shift shaft, etc., shown in FIG. 16.
Figure 18:
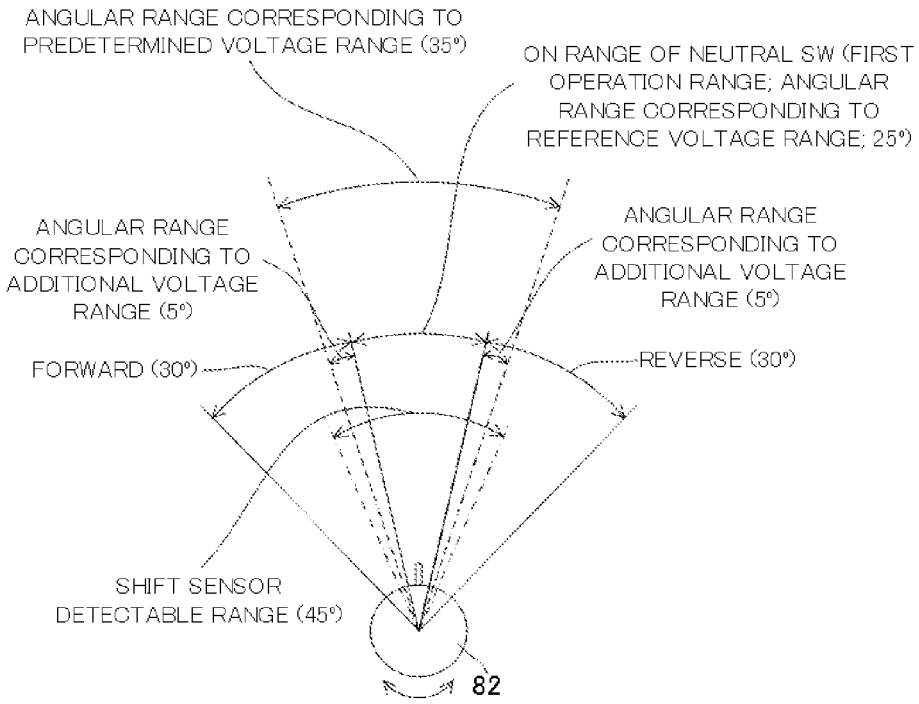
FIG. 18 is an explanatory view similar to FIG. 7, but for explaining an operation range (ON range) in which a neutral switch shown in FIG. 15 outputs an ON signal.

FIG. 13 is an enlarged sectional side view partially showing an outboard motor on which an outboard motor control apparatus according to the second embodiment is applied, FIG. 14 is an enlarged side view of the outboard motor shown in FIG. 13, FIG. 15 is a plan view showing a region around the second shift shaft 82 shown in FIG. 13 when viewed from the top, FIG. 16 is an enlarged side view of the second shift shaft 82, shift arm 90 and shift sensor 103, etc., shown in FIG. 13, FIG. 17 is an enlarged plan view of the second shift shaft 82, etc., shown in FIG. 16, and FIG. 18 is an explanatory view for explaining the operation range (ON range) in which the neutral switch 100 outputs the ON signal. Note that the shift sensor 103 is omitted in FIG. 15.

As clearly shown in FIGS. 16 and 17, the shift sensor 103 is positioned above the shift arm 90 in the vertical direction and attached at the upper end of the second shift shaft 82. The shift sensor 103 comprises a rotational angle sensor such as a potentiometer and produces an output voltage [V] indicative of the rotational angle of the second shift shaft 82.

A range of the rotational angle to be detected by the shift sensor 103 does not cover the entirety of the aforementioned rotatable range of the second shift shaft 82 (about 85 degrees) but covers only a part of the range. Specifically, as indicated by dashed-dotted lines in FIG. 18, the shift sensor 103 can detect the rotational angle in a range including the first operation range and additional ranges added to the both sides of the first operation range, more exactly, in the range of about 45 degrees including the first operation range (about 25 degrees) and prescribed angle ranges (e.g., 10 degrees each) added thereto on its forward and reverse sides.

Figure 19:
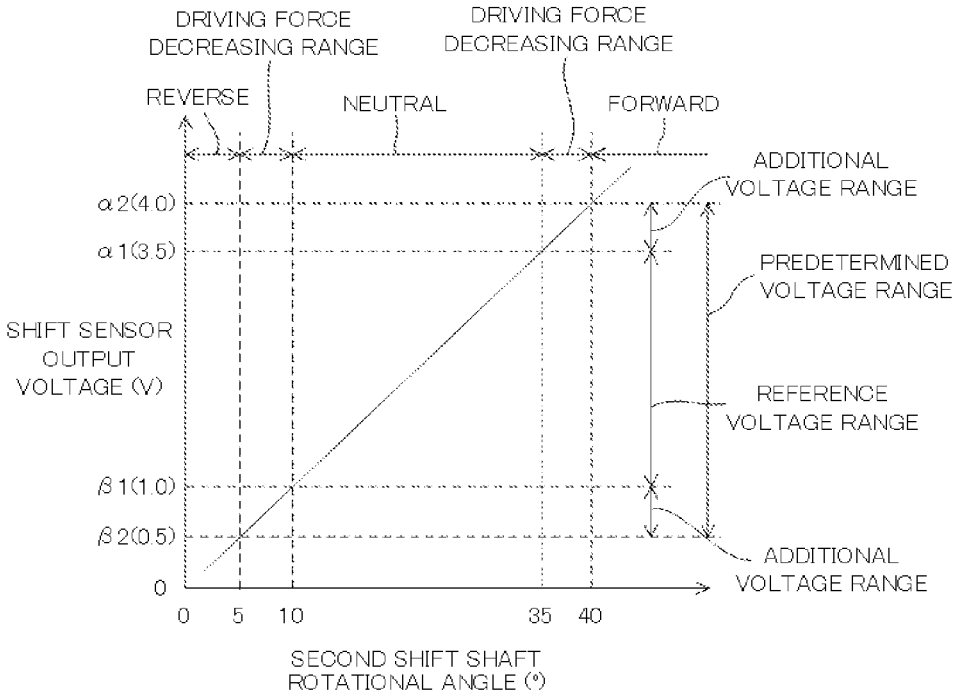
FIG. 19 is a graph showing the characteristics of an output voltage of a shift sensor with respect to a rotational angle of the second shift shaft shown in FIG. 13.

FIG. 19 is a graph showing the characteristics of the output voltage of the shift sensor 103 with respect to the rotational angle of the second shift shaft 82. In FIG. 19, the rotational angle of the shift shaft 82 is assumed to increase as the shift position is moved from the reverse position, via the neutral position, to the forward position.

As shown in FIG. 19, the shift sensor 103 produces the output voltage proportional to the rotational angle of the second shift shaft 82 and it is designed so that the output voltage per 1 degree of rotational angle of the shift shaft 82 is 0.1 V.

The engine control operation executed by the ECU 26 in the outboard motor 10 configured as above will be explained.

Figure 20:
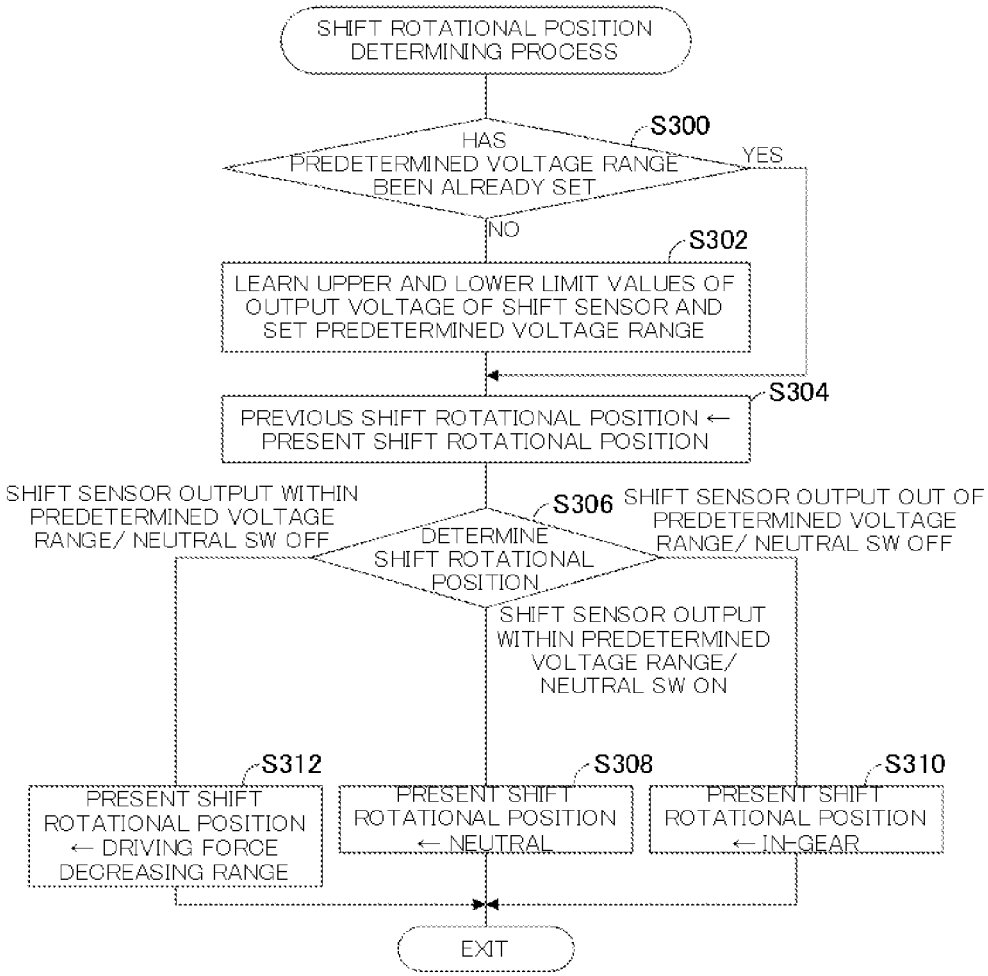
FIG. 20 is a subroutine flowchart similar to FIG. 9, but showing a shift rotational position determining process in FIG. 8 according to the second embodiment.

First, the processing of S10 to S14 of FIG. 8 is conducted similarly to that in the first embodiment. When the result in S14 is negative, the program proceeds to S16, in which a shift rotational position determining process is conducted. FIG. 20 is a subroutine flowchart showing an alternative example of the shift rotational position determining process of the first embodiment in FIG. 9.

First, in S300, it is determined whether a predetermined voltage range (described later) has been already set. When the processing of S300 is first conducted, the result is generally negative and the program proceeds to S302, in which the predetermined voltage range is set based on the output of the neutral switch 100 and the output voltage of the shift sensor 103.

The processing of S302 is explained with reference to FIGS. 18 and 19. First, when the rotational angle of the second shift shaft 82 is within the first operation range, i.e., when the neutral switch 100 produces the ON signal, an upper limit value $\alpha 1$ and lower limit value $\beta 1$ of the output voltage produced by the shift sensor 103 are learned or stored, so that a "reference voltage range" to be used for setting the predetermined voltage range is defined with those values $\alpha 1$ and $\rho 1$.

To be more specific, when, for instance, the first operation range (25 degrees) indicative of the neutral position is a range between 10 degrees and 35 degrees of the rotational angle shown in FIG. 19, the upper limit value $\alpha 1$ and lower limit value $\beta 1$ of the output voltage of the shift sensor 103 are to be 3.5 V and 1.0 V, respectively. The upper and lower limit values $\alpha 1$ and $\beta 1$ are learned and the range therebetween is defined as the reference voltage range.

Next "additional voltage ranges" are separately defined on the plus side (forward side) of the upper limit value $\alpha 1$ and the minus side (reverse side) of the lower limit value $\beta 1$. More precisely, a value obtained by adding a prescribed value (e.g., 0.5 V) to the upper limit value $\alpha 1$ is set as a voltage value $\alpha 2$ (4.0 V), while a value obtained by subtracting a prescribed value (e.g., 0.5 V) from the lower limit value $\beta 1$ is set as a voltage value $\beta 2$ (0.5 V). Then a range between the upper limit value $\alpha 1$ and the voltage value $\alpha 2$ and a range between the lower limit value $\beta 1$ and the voltage value $\beta 2$ are defined as the additional voltage ranges.

It should be noted that the additional voltage range is set to 0.5 V because load on the operator caused by the shift lever manipulation is increased in ranges from the upper and lower limit values $\alpha 1$, $\beta 1$ of the reference voltage range plus and minus 0.5 V or thereabout. Specifically, when 0.5 V is converted to the rotational angle of the shift shaft 82, it becomes an angular range of about 5 degrees and, in the case of FIG. 19, corresponds to angular ranges of 5 to 10 degrees and of 35 to 40 degrees. Generally, when the rotational angle is within those angular ranges, the shift lever manipulation load is increased. In this embodiment, since the additional voltage range is thus set to 0.5 V, the driving force of the engine 44 can be decreased at the appropriate timing when the lever manipulation load is increased, thereby reliably mitigating the shift lever manipulation load.

Next, the "predetermined voltage range" is set using the above reference voltage range and the additional voltage ranges. Specifically, the predetermined voltage range is to be a range between the voltage value $\beta 2$ and the voltage value $\alpha 2$.

FIG. 18 shows the angular ranges of the shift shaft 82 rotation corresponding to the reference voltage range, additional voltage ranges and predetermined voltage range. As can be seen in FIG. 18, when the output voltage of the shift sensor 103 is within the predetermined voltage range, it means that the rotational angle of the second shift shaft 82 is within the first operation range or in the vicinity thereof.

The explanation on FIG. 20 is resumed. Next the program proceeds to S304 to conduct the same processing as in S100 of the FIG. 9 flowchart. Note that, in a program loop after the predetermined voltage range is set in S302, the result in S300 is affirmative and, skipping S302, the program proceeds to S304.

Next the program proceeds to S306, in which the rotational position of the second shift shaft 82 is determined based on the outputs of the neutral switch 100 and shift sensor 103. Specifically, when the output voltage of the shift sensor 103 is within the predetermined voltage range and the neutral switch 100 produces the output (ON signal), it is discriminated that the rotational position of the shift shaft 82 (i.e., the rotational position (angle) of the protrusion of the shift shaft 82 shown in FIG. 18) is within the first operation range and the shift position is in the neutral position. Then the program proceeds to S308, in which the present shift rotational position is set as the "neutral."

When, in S306, the output voltage of the shift sensor 103 is out of the predetermined voltage range and the neutral switch 100 produces no output, i.e., is made OFF, it is discriminated that the rotational position of the shift shaft 82 is out of an angular range corresponding to the predetermined voltage range and the shift position is in the in-gear position, and the program proceeds to S310, in which the present shift rotational position is set as the "in-gear."

Further, when the output voltage of the shift sensor 103 is within the predetermined voltage range and the neutral switch 100 produces no output, the rotational position of the shift shaft 82 is determined to be within angular ranges corresponding to the additional voltage ranges shown in FIG. 18 and the program proceeds to S312, in which the present shift rotational position is set as the "driving force decreasing range."

Following the shift rotational position determining process in FIG. 20, the program proceeds to S18 in FIG. 8, in which the shift load decreasing control determining process is conducted similarly to the first embodiment.

Figure 21:
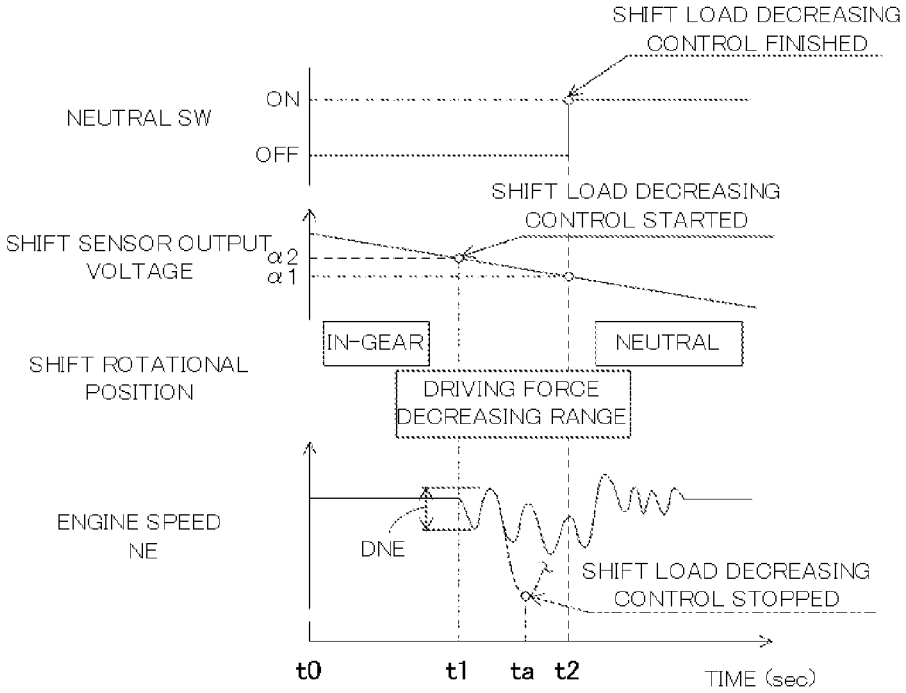
FIG. 21 is a time chart for explaining a part of the processes in FIG. 20, etc.

FIG. 21 is a time chart for explaining a part of the foregoing processes. FIG. 21 shows the case where the shift rotational position is moved from the forward (in-gear), via the driving force decreasing range, to the neutral and the predetermined voltage range has been already set.

As shown in FIG. 21, from the time t0 to t1, since the output voltage of the shift sensor 103 is out of the predetermined voltage range (i.e., equal to or greater than the voltage value $\alpha 2$) and the neutral switch 100 produces no output (is made OFF), the rotational position of the second shift shaft 82 is determined to be the in-gear (S310).

When the shift lever 22 is manipulated from the forward position to the neutral position and, at the time t1, the shift rotational position is moved from the in-gear to the driving force decreasing range so that the output voltage of the shift sensor 103 is within the predetermined voltage range and the neutral switch 100 remains OFF, i.e., when the neutral operation is detected, the shift load decreasing control for decreasing the driving force of the engine 44 is started (S312, S206 to S210).

Then the shift lever 22 is further manipulated to the neutral position. When, at the time t2, the shift rotational position is moved from the driving force decreasing range to the neutral so that the output voltage of the shift sensor 103 is within the predetermined voltage range and the neutral switch 100 produces the output (ON signal), the shift load decreasing control is finished (S200, S234).

As mentioned in the foregoing, in the apparatus or method in the second embodiment, the neutral operation detector includes: a shift shaft (second shift shaft) 82 adapted to be rotated in response to manipulation by an operator to switch the shift position between the in-gear position and the neutral position; a neutral switch 100 adapted to produce an output when a rotational angle of the shift shaft 82 is within an operation range (first operation range) indicative of the neutral position; a shift sensor 103 adapted to produce an output voltage indicative of the rotational angle of the shift shaft 82; and a voltage range setter (ECU 26, S16, S302) adapted to set a predetermined voltage range using a reference voltage range that is defined with upper and lower limit values $\alpha 1$, $\beta 1$ of the output voltage to be generated by the shift sensor 103 when the rotational angle of the shift shaft 82 is within the operation range, and additional voltage ranges that are separately defined on a plus side of the upper limit value $\alpha 1$ and a minus side of the lower limit value $\beta 1$, and determines that the neutral operation is conducted when the output voltage of the shift sensor 103 is within the set predetermined voltage range and the neutral switch 100 produces no output (S16, S18, 304 to S312, S206 to S210).

With this, the driving force of the engine 44 can be decreased at the appropriate timing, thereby reliably mitigating the shift lever manipulation load. Specifically, it becomes possible to accurately detect the switching timing of the shift position from the in-gear position to the neutral position based on the output voltage of the shift sensor 103 and the output of the neutral switch 100 and since the driving force decreasing control is started at the detected suitable timing, it makes easy to release the engagement of the clutch 74 with the forward or reverse gear 70, 72 (in-gear condition), thereby mitigating the shift lever manipulation load.

Further, it is configured so that the predetermined voltage range referred to when determining whether the driving force should be decreased is set by using the reference voltage range that is defined with the upper and lower limit values $\alpha 1$, $\beta 1$ of the output voltage to be generated by the shift sensor 103 when the rotational angle of the shift shaft 82 is within the first operation range, in other words, the upper and lower limit values $\alpha 1$, $\beta 1$ are learned based on the rotational angle of the shift shaft 82 and based on the learned values, the predetermined voltage range is set. With this, it becomes possible to accurately set the predetermined voltage range without taking the installation error of the shift sensor 103, etc., into account, thereby enabling to decrease the driving force of the engine 44 at the appropriate timing.

Further, since the driving force is decreased at the appropriate timing, unnecessary driving force decreasing control can be avoided and consequently, the engine speed (idling speed) after the shift position is switched to the neutral position can be stable.

The remaining configuration as well as the effects is the same as that in the first embodiment.

An outboard motor control apparatus according to a third embodiment will be next explained.

Conventionally, in the case where a plurality of the outboard motors (10) (that are configured as described in '496, for instance) are mounted on the boat (1) and the operations thereof are separately controlled through associated shift levers (22), the timing of starting the above-mentioned driving force decreasing control of the engine (44) to be started upon detection of the neutral operation may differ among the outboard motors (10) depending on the shift lever manipulation. Accordingly, load on the operator caused by the shift lever manipulation may also differ among the shift levers (22), disadvantageously.

Therefore, a third embodiment is configured such that, when a plurality of the outboard motors 10 described in the first embodiment are mounted on the boat 1, the driving force decreasing control of the engine 44 is performed to mitigate the shift lever manipulation load on the operator, while preventing different manipulation load from being generated among the outboard motors 10, i.e., among the shift levers 22.

Figure 22:
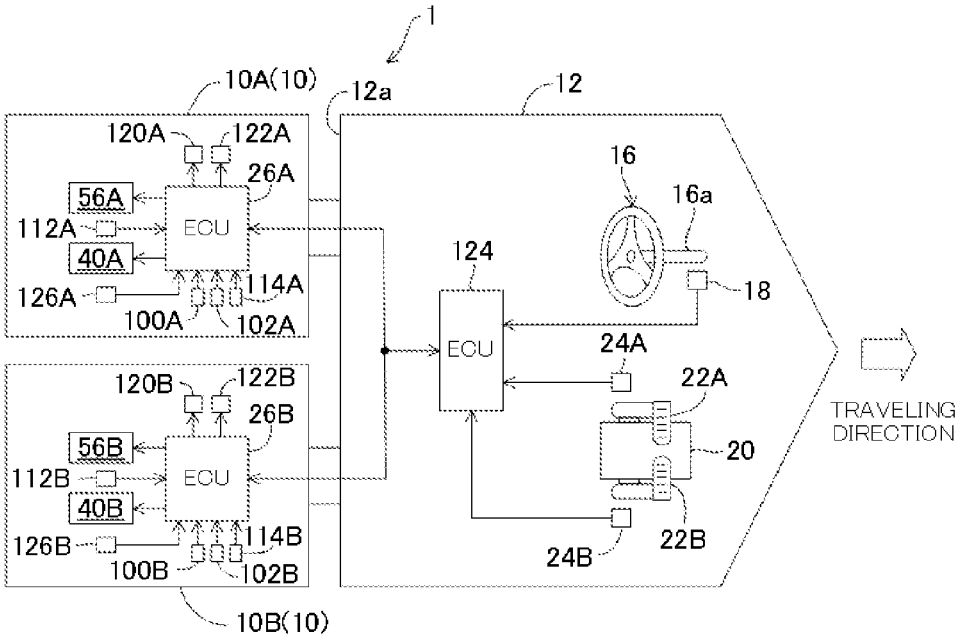
FIG. 22 is a block diagram showing an outboard motor control apparatus according to a third embodiment of the invention.

FIG. 22 is a block diagram showing an outboard motor control apparatus according to the third embodiment.

The explanation will be made with focus on points of difference from the first embodiment. As shown in FIG. 22, the stern or transom 12*a* of the hull 12 of the boat 1 is mounted with a plurality of, i.e., two outboard motors 10. In other words, the boat 1 has what is known as a multiple or dual outboard motor installation. In the following, the port side outboard motor, i.e., outboard motor on the left side when looking in the direction of forward travel is called the "first outboard motor" and assigned by symbol 10A, while the starboard side outboard motor, i.e., outboard motor on the right side the "second outboard motor" and assigned by symbol 10B.

The remote control box 20 of the hull 12 is installed with a plurality of, i.e., two shift levers 22. In the following, the shift lever on the left side when looking in the direction of forward travel is called the "first shift lever 22A" and the shift lever on the right side the "second shift lever 22B."

The first shift lever 22A is used to input a shift change command and an engine speed regulation command including an engine acceleration and deceleration command for the first outboard motor 10A, while the second shift lever 22B is used to input a shift change command and an engine speed regulation command for the second outboard motor 10B.

A first lever position sensor 24A and second lever position sensor 24B are installed near the first shift lever 22A and second shift lever 22B to produce outputs or signals corresponding to positions of the levers 22A, 22B, respectively.

The outputs of the steering angle sensor 18 and first and second lever position sensors 24A, 24B are sent to a boat ECU 124 that is installed at an appropriate position of the hull 12 of the boat 1. The boat ECU 124 has a microcomputer including a CPU, ROM, RAM and other devices, similarly to the ECU 26 on the outboard motor side (hereinafter called the "outboard motor ECU").

The explanation on the first and second outboard motors 10A, 10B will be made. Since the above outboard motors 10A, 10B have substantially the same configurations, the suffixes of A and B are omitted in the following explanation and figures unless necessary to distinguish the two outboard motors 10A, 10B.

In the third embodiment, the outboard motor 10 is configured almost the same as in the first embodiment. In the outboard motor 10, the shift position is changed in response to the manipulation of the associated shift lever 22 (i.e., the first shift lever 22A in the case of the first outboard motor 10A and the second shift lever 22B in the case of the second outboard motor 10B).

To be specific, the link pin 94 of the first outboard motor 10A (second outboard motor 10B) is connected to the first shift lever 22A (second shift lever 22B) of the hull 12 through the push-pull cable 96. Owing to this configuration, when the first shift lever 22A is manipulated by the operator, as mentioned above, the push-pull cable 96 is operated to move the link pin 94 and the like, thereby rotating the second shift shaft 82 and first shift shaft 76. Accordingly, the clutch 74, etc., are displaced appropriately so that the shift position of the first outboard motor 10A is switched among the forward, reverse and neutral positions. The second shift lever 22B also has the similar relationship with the outboard motor 10B.

Further, in addition to the sensors described in the first embodiment, a rudder angle sensor 126 is installed near the swivel shaft 36 to produce an output or signal indicative of a rotational angle of the swivel shaft 36, i.e., a rudder angle of the outboard motor 10.

The outputs of the sensors including the rudder angle sensor 126 are sent to the ECU 26 mounted on the outboard motor 10 on which those sensors are installed. Hereinafter the ECU of the first outboard motor 10A is called the "first outboard motor ECU 26A" and that of the second outboard motor 10B the "second outboard motor ECU 26B."

The first and second outboard motor ECUs 26A, 26B and the boat ECU 124 are interconnected to be able to communicate with each other through, for example, a communication method standardized by the National Marine Electronics Association (NMEA), i.e., through a Controller Area Network (CAN). The first and second outboard motor ECUs 26A, 26B acquire information including the steering angle of the steering wheel 16, the status of a shift load decreasing control coordination enable flag (described later), etc., from the boat ECU 124, while the boat ECU 124 acquires information including the operating condition of the engine 44 such as the engine speed NE, throttle opening TH, etc., from the outboard motor ECUs 26A, 26B. Further, the first outboard motor ECU 26A acquires information including the status of the shift load decreasing control start flag (described later) from the second outboard motor 26B, and vice versa.

Based on the received (or acquired) sensor outputs, the first outboard motor ECU 26A controls the operation of the steering motor 40 to steer the first outboard motor 10A. Further, based on the output of the first lever position sensor 24A, etc., the first outboard motor ECU 26A controls the operation of the throttle motor 56 to open and close the throttle valve 54, thereby regulating the throttle opening TH.

Furthermore, based on the sensor outputs and switch outputs, the first outboard motor ECU 26A determines the fuel injection amount and ignition timing of the engine 44, so that fuel of the determined fuel injection amount is supplied through the injector 120A (shown in FIG. 22) and the air-fuel mixture composed of the injected fuel and intake air is ignited by the ignition device 122A (shown in FIG. 22) at the determined ignition timing. The same applies to the second outboard motor ECU 26B. In other words, the operations of the first and second outboard motors 10A, 10B are respectively controlled by the first and second outboard motor ECUs 26A, 26B, individually.

Figure 23:
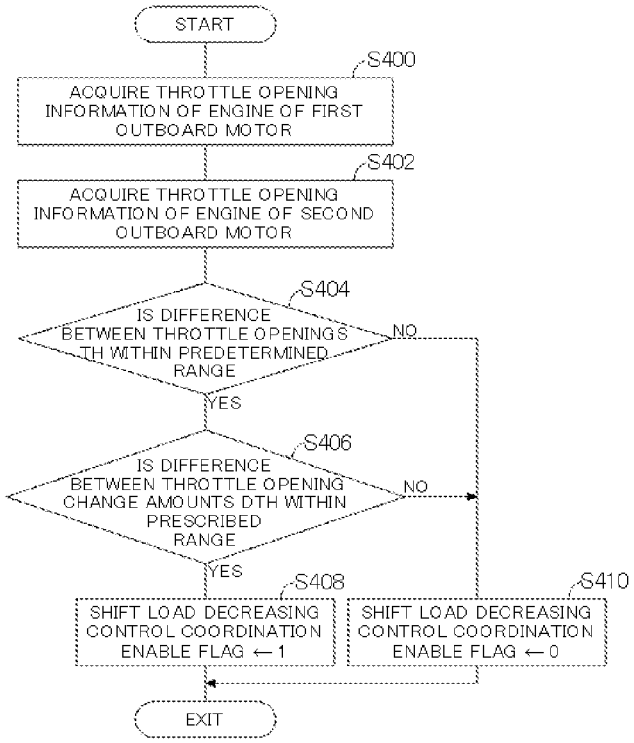
FIG. 23 is a flowchart showing a coordination enable control operation of each outboard motor to be executed by a boat ECU shown in FIG. 22.

FIG. 23 is a flowchart showing a coordination enable control operation of each outboard motor 10A, 10B to be executed by the boat ECU 124. The illustrated program is executed at predetermined intervals, e.g., 100 milliseconds. Note that the program of the engine control operation in FIG. 8 is executed by each of the first and second outboard motor ECUs 26A, 26B and the programs of FIG. 8 and FIG. 23 are concurrently processed.

First, the program begins at S400, in which information on the throttle opening TH of the engine 44 of the first outboard motor 10A (i.e., the throttle opening TH and throttle opening change amount DTH detected or calculated in S10 and S12 of FIG. 8) is acquired (read) from the first outboard motor ECU 26A. Then the program proceeds to S402, in which, similarly, information on the throttle opening TH of the engine 44 of the second outboard motor 10B (i.e., the throttle opening TH and throttle opening change amount DTH) is acquired from the second outboard motor ECU 26B.

Next the program proceeds to S404, in which the throttle openings TH acquired in S400 and S402 are compared with each other to calculate a difference therebetween and it is determined whether the calculated difference is within a predetermined range. Specifically, it is determined whether a difference obtained by subtracting the throttle opening TH of the engine 44 of the second outboard motor 10B from that of the first outboard motor 10A is within the predetermined range. The predetermined range is set as a criterion for determining whether the operating conditions of the engines 44 of the outboard motors 10A, 10B are relatively close, e.g., a range from −5 degrees to +5 degrees.

When the result in S404 is affirmative, the program proceeds to S406, in which the throttle opening change amounts DTH of the first and second outboard motors 10A, 10B are compared with each other to calculate a difference therebetween and it is determined whether the calculated difference is within a prescribed range. Specifically, it is determined whether a difference obtained by subtracting the change amount DTH of the engine 44 of the second outboard motor 10B from that of the first outboard motor 10A is within the prescribed range. The prescribed range is set as a criterion for determining whether the operating conditions of the engines 44 of the outboard motors 10A, 10B are relatively close, e.g., a range from −3 degrees to +3 degrees.

In other words, S404 and S406 are conducted to compare the operating conditions of the engines 44 of the first and second outboard motors 10A, 10B and determine whether the operating conditions are close to each other.

When the result in S406 is affirmative, the program proceeds to S408, in which the bit of the shift load decreasing control coordination enable flag is set to 1. On the other hand, when the result in S404 or S406 is negative, the program proceeds to S410, in which the bit of the enable flag is reset to 0. Thus, the bit of the enable flag is set to 1 when the operating conditions of the first and second outboard motors 10A, 10B are close so that the shift load decreasing control to be conducted for the outboard motors 10A, 10B in a coordinated manner is enabled or allowed, and otherwise, reset to 0.

Next, the engine control operation of the first outboard motor 10A by the first outboard motor ECU 26A will be explained. Note that the following explanation of the engine control operation also applies to the second outboard motor ECU 26B.

First, the processing of S10 to S16 of FIG. 8 is conducted similarly to those in the first embodiment. The program proceeds to S18, in which shift load decreasing control determining process is conducted.

Figure 24:
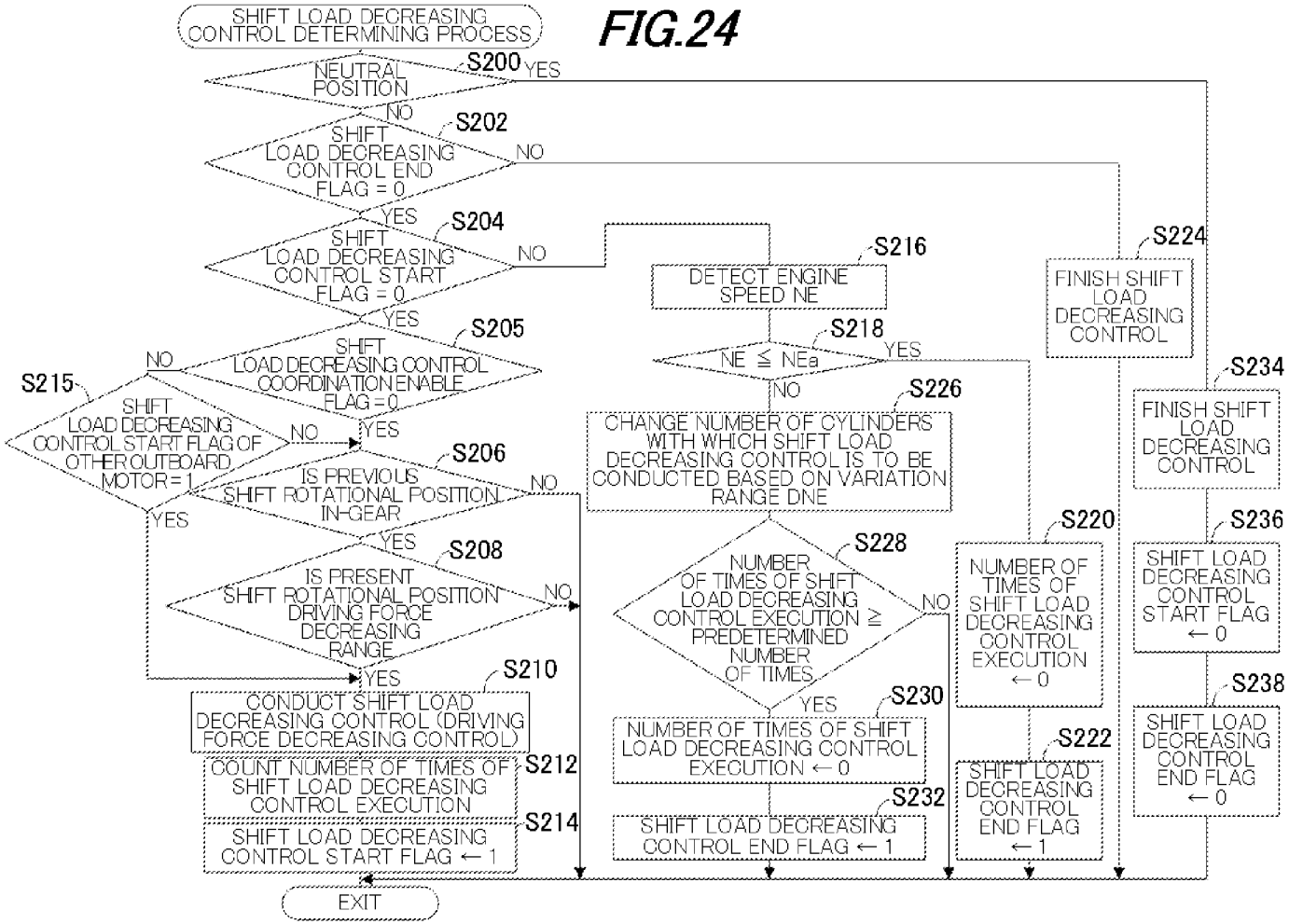
FIG. 24 is a subroutine flowchart similar to FIG. 10, but showing a shift load decreasing control determining process in FIG. 8 according to the third embodiment.

FIG. 24 is a subroutine flowchart showing the process similar to FIG. 10.

The processing of S200 to S204 is conducted similarly to the FIG. 10 flowchart. When the result in S204 is affirmative, i.e., when the bit of the shift load decreasing control start flag is 0, the program proceeds to S205, in which it is determined whether the bit of the shift load decreasing control coordination flag is 0.

When the result in S205 is affirmative, the program proceeds to S206, and up to S214, the process is conducted similarly to the FIG. 10 flowchart.

When the result in S205 is negative, the program proceeds to S215, in which it is determined whether the bit of the shift load decreasing control start flag of the other outboard motor (in this case, the second outboard motor 10B) is 1, i.e., whether the neutral operation is detected so that the shift load decreasing control is started in the other outboard motor. In the case where this program is executed by the second outboard motor ECU 26B, "the other outboard motor" indicates the first outboard motor 10A, naturally.

When the result in S215 is negative, the program proceeds to S206 onward, while when the result is affirmative, the program skips S206 and S208 and proceeds to S210, in which the aforementioned shift load decreasing control is started.

Thus, when the neutral operation of at least one of a plurality of the outboard motors (10A, 10B) (e.g., the second outboard motor 10B here) is detected, the shift load decreasing control to decrease the driving force of the engines 44 to mitigate the shift lever manipulation load is conducted or started in all of the outboard motors, i.e., in the outboard motor (10B) in which the neutral operation is detected and the other outboard motor(s) (10A).

The other processing of the FIG. 24 flowchart is the same as the FIG. 10 flowchart and the explanation thereof is omitted.

Figure 25:
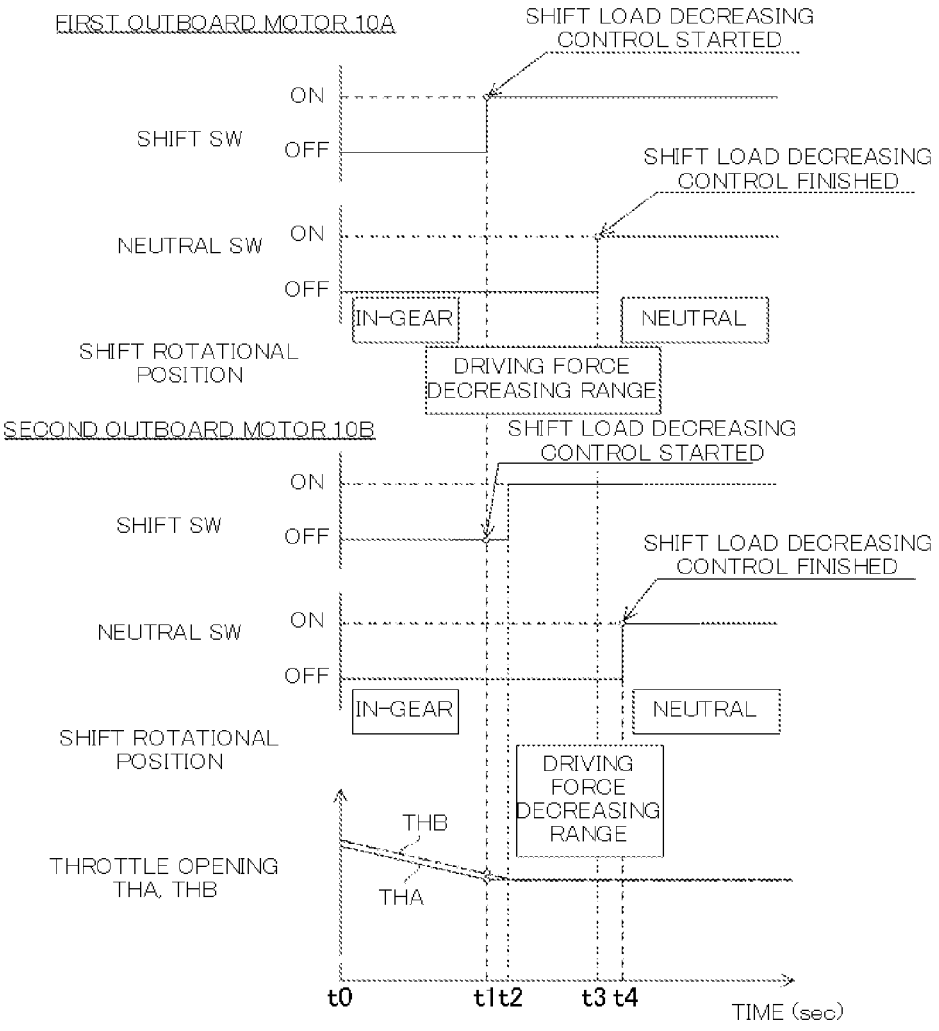
FIG. 25 is a time chart for explaining a part of the processes in FIG. 23, etc.

FIG. 25 is a time chart for explaining a part of the foregoing processes. FIG. 25 shows the case where the first and second shift levers 22A, 22B are both manipulated in parallel by the operator and the shift rotational positions of the shift shafts of the first and second outboard motors 10A, 10B are moved from the forward (in-gear), via the driving force decreasing range, to the neutral. In the figure, there are shown, in the order from the top, the condition of the output of the shift switch 102, etc., of the first outboard motor 10A, the same of the second outboard motor 10B, and the throttle opening (now assigned by THA) of the first outboard motor 10A and the throttle opening (now assigned by THB) of the second outboard motor 10B.

As shown in FIG. 25, from the time t0 to t1, since none of the neutral switches 100 and shift switches 102 of the first and second outboard motors 10A, 10B produce output (i.e., they are all made OFF), the rotational positions of the second shift shafts 82 are determined to be the in-gear (S106).

When the first and second shift levers 22A, 22B are manipulated from the forward position to the neutral position and, at the time t1, in the first outboard motor 10A, the shift rotational position is moved from the in-gear to the driving force decreasing range so that the shift switch 102 is made ON and the neutral switch 100 remains OFF, i.e., when the neutral operation is detected, the shift load decreasing control is started (S108, 5206 to S210).

At that time, although the shift rotational position of the second outboard motor 10B remains the in-gear, if the difference between the throttle openings THA, THB of the first and second outboard motors 10A, 10B is within the predetermined range and the difference between the throttle opening change amounts DTH thereof is also within the prescribed range, the shift load decreasing control is started also in the second outboard motor 10B (S205, S215, S210). Subsequently, the shift rotational position of the second outboard motor 10B is moved from the in-gear to the driving force decreasing range at the time t2.

As a result, the engine speeds NE of the first and second outboard motors 10A, 10B are changed and gradually decreased. Consequently, it makes easy to release the engagement of the clutch 74 with the forward gear 70 in each outboard motor 10A, 10B, thereby mitigating the load on the operator caused by the manipulation of the shift levers 22A, 22B. Further, the first and second shift levers 22A, 22B do not differ in their manipulation load from each other.

Next the shift levers 22A, 22B are further manipulated to the neutral positions. When, at the time t3, in the first outboard motor 10A, the shift rotational position is moved from the driving force decreasing range to the neutral and the neutral switch 100 and shift switch 102 both produce the outputs (ON signals), the shift load decreasing control of the first outboard motor 10A is finished (S200, S232).

When, at the time t4, in the second outboard motor 10B, the shift rotational position is moved from the driving force decreasing range to the neutral and the neutral switch 100 and shift switch 102 both produce the outputs (ON signals), the shift load decreasing control of the second outboard motor 10B is finished (S200, S232). Thus, it is configured so that the shift load decreasing controls of the first and second outboard motors 10A, 10B are started at the same timing, while the controls thereof are finished at different timing based on the shift rotational positions, etc., of the outboard motors 10A, 10B.

As mentioned in the foregoing, in the apparatus or method in the third embodiment, a plurality of the outboard motors (first and second outboard motors 10A, 10B) are mounted on a hull 12 of a boat 1, the neutral operation detector is installed in each of the outboard motors 10A, 10B, and the driving force controller conducts the driving force decreasing control in all of the outboard motors 10A, 10B when the neutral operation of at least one of the outboard motors 10A, 10B is detected (S18, S206 to S210, S214, S215).

With this, it becomes easy to release the engagement of the clutch 74 with the forward or reverse gear 70 or 72 (in-gear condition) in all the outboard motors 10A, 10B, thereby mitigating the shift lever manipulation load, while preventing different manipulation load from being generated among the outboard motors 10A, 10B, i.e., among the shift levers 22A, 22B.

The apparatus includes: a comparator (boat ECU 124, S400 to S410) adapted to compare operating conditions of the engines 44 of the outboard motors 10A, 10B with each other, and the driving force controller conducts the driving force decreasing control based on a result of the comparing by the comparator (S18, S205 to S210, S214, S215). With this, it becomes possible to conduct the driving force decreasing control when the operating conditions of the engines 44 of the outboard motors 10A, 10B are relatively close to each other, i.e., when the operating condition of the engine 44 of one of the outboard motors in which the neutral operation is detected is relatively close to that of the other outboard motor. Therefore, the manipulation load can be reliably decreased in all the outboard motors 10A, 10B.

In the apparatus, the comparator compares throttle openings TH of the engines 44 of the outboard motors 10A, 10B with each other to calculate a difference therebetween and compares change amounts DTH of the throttle openings TH with each other to calculate a difference therebetween (S404, S406), and the driving force controller conducts the driving force decreasing control when the difference between the throttle openings TH is within a predetermined range and the difference between the change amounts DTH is within a prescribed range (S18, S205 to S210, S214, S215). Since the driving force decreasing control is conducted when the operating conditions of the engines 44 of the outboard motors 10A, 10B are relatively close to each other, the manipulation load can be further reliably decreased in all the outboard motors 10A, 10B.

The remaining configuration as well as the effects is the same as that in the first embodiment.

As stated above, in the first to third embodiments, it is configured to have an apparatus or method for controlling operation of an outboard motor 10 having an internal combustion engine 44 equipped with a plurality of cylinders, the outboard motor 10 being configured to switch a shift position between an in-gear position that enables driving force of the engine 44 to be transmitted to a propeller 62 by engaging a clutch 74 with one of a forward gear 70 and a reverse gear 72 and a neutral position that cuts off transmission of the driving force by disengaging the clutch 74 from the forward or reverse gear 70, 72, comprising: a neutral operation detector (ECU 26, first and second outboard motor ECUs 26A, 26B, S16, S18, S100 to S108, S206, S208, S304 to S312) adapted to detect a neutral operation in which the shift position is switched from the in-gear position to the neutral position; a driving force controller (ECU 26, first and second outboard motor ECUs 26A, 26B, S18, S210) adapted to conduct driving force decreasing control (shift load decreasing control) to decrease the driving force of the engine 44 when the neutral operation is detected; and a cylinder number changer (ECU 26, first and second outboard motor ECUs 26A, 26B, S18, S226) adapted to detect a variation range DNE of a speed of the engine NE during the driving force decreasing control and determine and change number of the cylinders with which the driving force decreasing control is to be conducted out of the plurality of the cylinders based on the detected variation range DNE.

Since the driving force decreasing control to decrease the driving force of the engine 44 is conducted when the neutral operation in which the shift position is switched from the in-gear position to the neutral position is detected, it makes easy to release the engagement of the clutch 74 with the forward or reverse gear 70 or 72 (in-gear condition), thereby mitigating the shift lever manipulation load.

Further, it is configured so that the variation range DNE of the engine speed NE is detected during (execution of) the shift load decreasing control and based on the detected variation range DNE, out of the plurality of the cylinders, the number of cylinders with which the driving force decreasing control should be conducted is determined and changed. With this, it becomes possible to appropriately conduct the driving force decreasing control. Specifically, even when the variation range DNE becomes excessive due to the driving force decreasing control, the number of cylinders with which the control is to be conducted is suitably decreased so that the variation range DNE can be suppressed (i.e., the engine operation can be stabilized), while preventing the engine stall.

In the apparatus in the first and third embodiments, the neutral operation detector includes: a shift shaft (second shift shaft) 82 adapted to be rotated in response to manipulation by an operator to switch the shift position between the in-gear position and the neutral position; a neutral switch 100 adapted to produce an output when a rotational angle of the shift shaft 82 is within a first operation range indicative of the neutral position; and a shift switch 102 adapted to produce an output when the rotational angle of the shift shaft 82 is within a second operation range including the first operation range and additional ranges successively added to both sides of the first operation range, and detects the neutral operation based on the outputs of the neutral switch 100 and the shift switch 102 (S16, S18, S100 to S108, S206, S208). With this, since it is discriminated that the neutral operation is done when the shift switch 102 produces the output and the neutral switch 100 produces no output, the neutral operation can be accurately detected with the simple structure.

In the apparatus, the neutral operation detector determines that the neutral operation is conducted when the shift switch 102 produces the output while the neutral switch 100 produces no output (S16, S18, S100, S108, S206, S208). With this, the neutral operation can be detected more accurately.

In the apparatus, the neutral switch 100 and the shift switch 102 are positioned to be able to contact with a cam (shift arm 90, cam 110) installed coaxially with the shift shaft 82 and produce the outputs upon contacting with the cam 90, 110. With this, the neutral switch 100 and shift switch 102 can be configured to be simple.

The apparatus further includes: a deceleration instruction determiner (throttle opening sensor 112, ECU 26, first and second outboard motor ECUs 26A, 26B, S14) adapted to determine whether deceleration is instructed to the engine 44 by the operator; and a driving force decreasing control prohibitor (ECU 26, first and second outboard motor ECUs 26A, 26B, S20) adapted to prohibit the driving force decreasing control when the deceleration is determined to be instructed. With this, it becomes possible to prevent occurrence of so-called water hammer that may be caused by suction of water through the exhaust pipe 66.

In the apparatus, the driving force controller decreases the driving force of the engine 44 by conducting at least one of ignition cut-off, ignition timing retarding and decrease of a fuel injection amount in the engine 44 (S210). With this, the driving force of the engine 44 can be reliably decreased, thereby effectively mitigating the shift lever manipulation load.

In the apparatus, the cylinder number changer decreases the number of the cylinders with which the driving force decreasing control is to be conducted as the detected variation range DNE of the engine speed is increased (S18, S226). With this, the driving force decreasing control can be conducted more reliably. Specifically, when, for instance, the variation range DNE is increased due to the driving force decreasing control, since the number of cylinders with which the control is to be conducted is suitably decreased so that the variation range DNE can be suppressed (i.e., the engine 44 operation can be stabilized), it becomes possible to prevent the engine stall more reliably.

The apparatus includes: a driving force decreasing control stopper (ECU 26, first and second outboard motor ECUs 26A, 26B, S18, S218 to S224, S228 to S232) adapted to stop the driving force decreasing control when the engine speed NE becomes equal to or less than a predetermined engine speed (stall limit engine speed NEa) after the driving force decreasing control is conducted or when the driving force decreasing control is conducted a predetermined number of times or more. With this, even when, for instance, the shift lever 22 is slowly manipulated from the in-gear position to the neutral position, the driving force decreasing control can be stopped before the engine 44 operation becomes unstable, i.e., it becomes possible to avoid longer execution of the driving force decreasing control than necessary. In other words, the driving force decreasing control can be appropriately conducted, while avoiding unstable operation of the engine 44.

In the apparatus or method in the second embodiment, the neutral operation detector includes: a shift shaft (second shift shaft) 82 adapted to be rotated in response to manipulation by an operator to switch the shift position between the in-gear position and the neutral position; a neutral switch 100 adapted to produce an output when a rotational angle of the shift shaft 82 is within an operation range (first operation range) indicative of the neutral position; a shift sensor 103 adapted to produce an output voltage indicative of the rotational angle of the shift shaft 82; and a voltage range setter (ECU 26, S16, S302) adapted to set a predetermined voltage range using a reference voltage range that is defined with upper and lower limit values $\alpha 1$, $\beta 1$ of the output voltage to be generated by the shift sensor 103 when the rotational angle of the shift shaft 82 is within the operation range, and additional voltage ranges that are separately defined on a plus side of the upper limit value $\alpha 1$ and a minus side of the lower limit value $\beta 1$, and determines that the neutral operation is conducted when the output voltage of the shift sensor 103 is within the set predetermined voltage range and the neutral switch 100 produces no output (S16, S18, 304 to S312, S206 to S210).

With this, the driving force of the engine 44 can be decreased at the appropriate timing, thereby reliably mitigating the shift lever manipulation load. Specifically, it becomes possible to accurately detect the switching timing of the shift position from the in-gear position to the neutral position based on the output voltage of the shift sensor 103 and the output of the neutral switch 100 and since the driving force decreasing control is started at the detected suitable timing, it makes easy to release the engagement of the clutch 74 with the forward or reverse gear 70, 72 (in-gear condition), thereby mitigating the shift lever manipulation load.

Further, it is configured so that the predetermined voltage range referred to when determining whether the driving force should be decreased is set by using the reference voltage range that is defined with the upper and lower limit values $\alpha 1$, $\beta 1$ of the output voltage to be generated by the shift sensor 103 when the rotational angle of the shift shaft 82 is within the first operation range, in other words, the upper and lower limit values $\alpha 1$, $\beta 1$ are learned based on the rotational angle of the shift shaft 82 and based on the learned values, the predetermined voltage range is set. With this, it becomes possible to accurately set the predetermine voltage range without taking the installation error of the shift sensor 103, etc., into account, thereby enabling to decrease the driving force of the engine 44 at the appropriate timing.

Further, since the driving force is decreased at the appropriate timing, unnecessary driving force decreasing control can be avoided and consequently, the engine speed (idling speed) after the shift position is switched to the neutral position can be stable.

In the apparatus or method in the third embodiment, a plurality of the outboard motors (first and second outboard motors 10A, 10B) are mounted on a hull 12 of a boat 1, the neutral operation detector is installed in each of the outboard motors 10A, 10B, and the driving force controller conducts the driving force decreasing control in all of the outboard motors 10A, 10B when the neutral operation of at least one of the outboard motors 10A, 10B is detected (S18, S206 to S210, S214, S215).

With this, it becomes easy to release the engagement of the clutch 74 with the forward or reverse gear 70 or 72 (in-gear condition) in all the outboard motors 10A, 10B, thereby mitigating the shift lever manipulation load, while preventing different manipulation load from being generated among the outboard motors 10A, 10B, i.e., among the shift levers 22A, 22B.

The apparatus includes: a comparator (boat ECU 124, S400 to S410) adapted to compare operating conditions of the engines 44 of the outboard motors 10A, 10B with each other, and the driving force controller conducts the driving force decreasing control based on a result of the comparing by the comparator (S18, S205 to S210, S214, S215). With this, it becomes possible to start the driving force decreasing control when the operating conditions of the engines 44 of the outboard motors 10A, 10B are relatively close to each other, i.e., when the operating condition of the engine 44 of one of the outboard motors in which the neutral operation is detected is relatively close to that of the other outboard motor. Therefore, the manipulation load can be reliably decreased in all the outboard motors 10A, 10B.

In the apparatus, the comparator compares throttle openings TH of the engines 44 of the outboard motors 10A, 10B with each other to calculate a difference therebetween and compares change amounts DTH of the throttle openings TH with each other to calculate a difference therebetween (S404, S406), and the driving force controller conducts the driving force decreasing control when the difference between the throttle openings TH is within a predetermined range and the difference between the change amounts DTH is within a prescribed range (S18, S205 to S210, S214, S215). Since the driving force decreasing control is started when the operating conditions of the engines 44 of the outboard motors 10A, 10B are relatively close to each other, the manipulation load can be further reliably decreased in all the outboard motors 10A, 10B.

It should be noted that, in the foregoing, although the engine is exemplified as the prime mover, it may be a hybrid combination of an engine and electric motor.

It should also be noted that, although the outboard motor is taken as an example, this invention can be applied to an inboard/outboard motor. Further, although the predetermined value DTHa, reference voltage range, additional voltage range, predetermined voltage range, predetermined range, prescribed range, displacement of the engine 44 and other values are indicated with specific values in the foregoing, they are only examples and not limited thereto.

It should also be noted that although, in the third embodiment, two outboard motors are mounted on the boat 1, the invention also applies to multiple outboard motor installations comprising three or more outboard motors.

Japanese Patent Application Nos. 2011-048847, 2011-048848 and 2011-048849, all filed on Mar. 7, 2011, are incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor having an internal combustion engine equipped with a plurality of cylinders, the outboard motor being configured to switch a shift position between an in-gear position that enables driving force of the engine to be transmitted to a propeller by engaging a clutch with one of a forward gear and a reverse gear and a neutral position that cuts off transmission of the driving force by disengaging the clutch from the forward or reverse gear, comprising: a neutral operation detector adapted to detect a neutral operation in which the shift position is switched from the in-gear position to the neutral position; a driving force controller adapted to conduct driving force decreasing control to decrease the driving force of the engine when the neutral operation is detected; and a cylinder number changer adapted to detect a variation range of a speed of the engine during the driving force decreasing control and determine and change number of the cylinders with which the driving force decreasing control is to be conducted out of the plurality of the cylinders based on the detected variation range, wherein the neutral operation detector includes: a shift shaft adapted to be rotated in response to manipulation by an operator to switch the shift position between the in-gear position and the neutral position; a neutral switch adapted to produce an output when a rotational angle of the shift shaft is within a first operation range indicative of the neutral position; and a shift switch adapted to produce an output when the rotational angle of the shift shaft is within a second operation range including the first operation range and additional ranges successively added to both sides of the first operation range, and detects the neutral operation based on the outputs of the neutral switch and the shift switch.

2. The apparatus according to claim 1, wherein the neutral operation detector determines that the neutral operation is conducted when the shift switch produces the output while the neutral switch produces no output.

3. The apparatus according to claim 1, wherein the neutral switch and the shift switch are positioned to be able to contact with a cam installed coaxially with the shift shaft and produce the outputs upon contacting with the cam.

4. The apparatus according to claim 1, further including: a deceleration instruction determiner adapted to determine whether deceleration is instructed to the engine by the operator; and a driving force decreasing control prohibitor adapted to prohibit the driving force decreasing control when the deceleration is determined to be instructed.

5. The apparatus according to claim 1, wherein the driving force controller decreases the driving force of the engine by conducting at least one of ignition cut-off, ignition timing retarding and decrease of a fuel injection amount in the engine.

6. The apparatus according to claim 1, wherein the cylinder number changer decreases the number of the cylinders with which the driving force decreasing control is to be conducted as the detected variation range of the engine speed is increased.

7. The apparatus according to claim 1, further including: a driving force decreasing control stopper adapted to stop the driving force decreasing control when the engine speed becomes equal to or less than a predetermined engine speed after the driving force decreasing control is conducted or when the driving force decreasing control is conducted a predetermined number of times or more.

8. An apparatus for controlling operation of an outboard motor having an internal combustion engine equipped with a plurality of cylinders, the outboard motor being configured to switch a shift position between an in-gear position that enables driving force of the engine to be transmitted to a propeller by engaging a clutch with one of a forward gear and a reverse gear and a neutral position that cuts off transmission of the driving force by disengaging the clutch from the forward or reverse gear, comprising: a neutral operation detector adapted to detect a neutral operation in which the shift position is switched from the in-gear position to the neutral position; a driving force controller adapted to conduct driving force decreasing control to decrease the driving force of the engine when the neutral operation is detected: and a cylinder number changer adapted to detect a variation range of a speed of the engine during the driving force decreasing control and determine and change number of the cylinders with which the driving force decreasing control is to be conducted out of the plurality of the cylinders based on the detected variation range, wherein the neutral operation detector includes: a shift shaft adapted to be rotated in response to manipulation by an operator to switch the shift position between the in-gear position and the neutral position; a neutral switch adapted to produce an output when a rotational angle of the shift shaft is within an operation range indicative of the neutral position; a shift sensor adapted to produce an output voltage indicative of the rotational angle of the shift shaft; and a voltage range setter adapted to set a predetermined voltage range using a reference voltage range that is defined with upper and lower limit values of the output voltage to be generated by the shift sensor when the rotational angle of the shift shaft is within the operation range, and additional voltage ranges that are separately defined on a plus side of the upper limit value and a minus side of the lower limit value, and determines that the neutral operation is conducted when the output voltage of the shift sensor is within the set predetermined voltage range and the neutral switch produces no output.

9. The apparatus according to claim 8, wherein the driving force controller decreases the driving force of the engine by conducting at least one of ignition cut-off, ignition timing retarding and decrease of a fuel injection amount in the engine.

10. The apparatus according to claim 8, further including: a deceleration instruction determiner adapted to determine whether deceleration is instructed to the engine by the operator; and a driving force decreasing control prohibitor adapted to prohibit the driving force decreasing control when the deceleration is determined to be instructed.

11. An apparatus for controlling operation of an outboard motor having an internal combustion engine equipped with a plurality of cylinders, the outboard motor being configured to switch a shift position between an in-gear position that enables driving force of the engine to be transmitted to a propeller by engaging a clutch with one of a forward gear and a reverse gear and a neutral position that cuts off transmission of the driving force by disengaging the clutch from the forward or reverse gear, comprising: a neutral operation detector adapted to detect a neutral operation in which the shift position is switched from the in-gear position to the neutral position; a driving force controller adapted to conduct driving force decreasing control to decrease the driving force of the engine when the neutral operation is detected; and a cylinder number changer adapted to detect a variation range of a speed of the engine during the driving force decreasing control and determine and change number of the cylinders with which the driving force decreasing control is to be conducted out of the plurality of the cylinders based on the detected variation range, wherein a plurality of the outboard motors are mounted on a hull of a boat, the neutral operation detector is installed in each of the outboard motors, and the driving force controller conducts the driving force decreasing control in all of the outboard motors when the neutral operation of at least one of the outboard motors is detected, further including: a comparator adapted to compare operating conditions of the engines of the outboard motors with each other, and the driving force controller conducts the driving force decreasing control based on a result of the comparing by the comparator.

12. The apparatus according to claim 11, wherein the comparator compares throttle openings of the engines of the outboard motors with each other to calculate a difference therebetween and compares change amounts of the throttle openings with each other to calculate a difference therebetween, and the driving force controller conducts the driving force decreasing control when the difference between the throttle openings is within a predetermined range and the difference between the change amounts is within a prescribed range.

13. The apparatus according to claim 11, wherein the driving force controller decreases the driving force of the engine by conducting at least one of ignition cut-off, ignition timing retarding and decrease of a fuel injection amount in the engine.

* * * * *